US007246898B2

(12) United States Patent
Nunokawa

(10) Patent No.: US 7,246,898 B2
(45) **Date of Patent: *Jul. 24, 2007**

(54) RECORDING METHOD, RECORDING APPARATUS AND COMPUTER-READABLE STORAGE MEDIUM

(75) Inventor: Hirokazu Nunokawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/505,351

(22) Filed: Aug. 17, 2006

(65) Prior Publication Data

US 2006/0274138 A1 Dec. 7, 2006

Related U.S. Application Data

(63) Continuation of application No. 10/610,598, filed on Jul. 2, 2003, now Pat. No. 7,114,804.

(30) Foreign Application Priority Data

Jul. 3, 2002 (JP) ..... 2002-195115

(51) Int. Cl.
*B41J 2/01* (2006.01)

(52) U.S. Cl. ..... 347/104; 347/347; 347/43

(58) Field of Classification Search ..... 347/104, 347/43, 19, 31, 34
See application file for complete search history.

(56) References Cited

U.S. PATENT DOCUMENTS 5,417,415 A 5/1995 Murakami 7,114,804 B2 * 10/2006 Nunokawa ..... 347/104

FOREIGN PATENT DOCUMENTS

JP 2001-260391 A 9/2001
JP 2002-103721 A 4/2002

* cited by examiner

*Primary Examiner*—Stephen Meier
*Assistant Examiner*—Ly T. Tran
(74) *Attorney, Agent, or Firm*—Sughrue Mion, PLLC

(57) ABSTRACT

The present invention is a recording method for recording by ejecting liquid onto a medium. The medium is carried in a carrying direction, the medium carried is supported by a protruding section of a support member having a recessed section and the protruding section, and liquid is ejected from nozzles in opposition to the recessed section and the protruding section. Also, with the recording method of the present invention, when recording to a front end in the carrying direction of the medium, the medium is carried to position the front end between the recessed section and nozzles in opposition to the recessed section, and liquid is ejected from nozzles in opposition to the recessed section and nozzles in opposition to the protruding section. This recording method allows recording to be performed quickly and without making peripheral areas dirty when recording to the front end of a medium without creating margins.

11 Claims, 20 Drawing Sheets

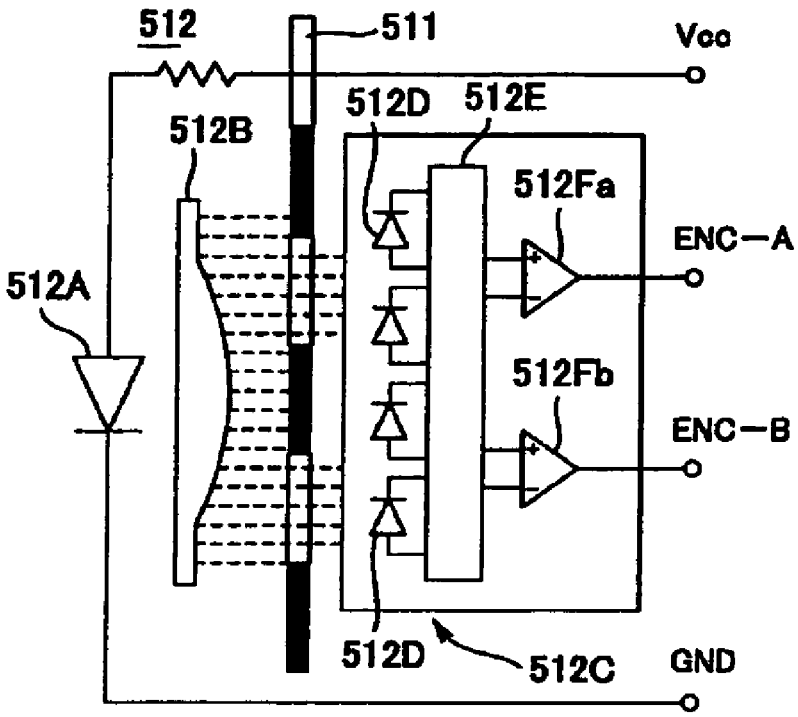
FIG. 5
FIG. 6A
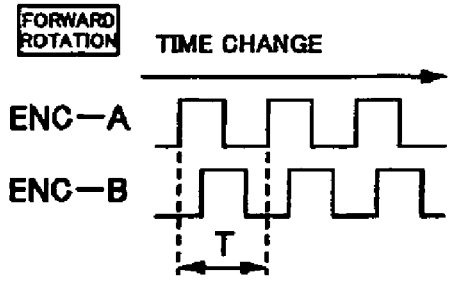
FIG. 6B
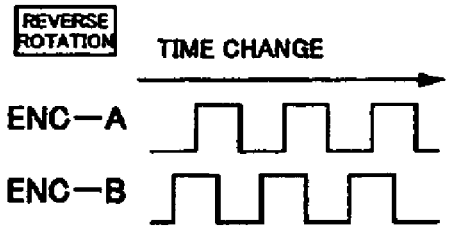

RECORDING METHOD, RECORDING APPARATUS AND COMPUTER-READABLE STORAGE MEDIUM

CROSS-REFERENCE TO RELATED APPLICATIONS

This is a continuation of application Ser. No. 10/610,598 filed Jul. 2, 2003 now U.S. Pat. No. 7,114,804. The entire disclosure of the prior application, application Ser. No. 10/610,598 is considered part of the disclosure of the present application and is hereby incorporated by reference. Additionally, the present application claims priority from Japanese Patent App. No. 2002-195115 filed on Jul. 3, 2002, which is herein incorporated by reference.

BACKGROUND OF THE INVENTION

1. Field of the Invention

The present invention relates to recording methods and recording apparatuses for recording to a medium such as paper. The present invention also relates to computer-readable storage media and printing systems storing a program for controlling such recording apparatuses.

2. Description of the Related Art

Inkjet printers for intermittently ejecting a liquid such as ink are known as an example of recording apparatuses for recording information onto a medium (including a medium to be recorded and a medium to be printed) such as paper, cloth, and film.

FIG. 23 is a schematic diagram of such an inkjet printer. This diagram shows how a paper S carried by a paper carrying unit 110 is supported by a supporting unit 114 and ink is ejected from nozzles provided in a head 121 so as to print the paper.

Such an inkjet printer can be used to perform printing without creating margins at the front end of the paper. However, due to the carry error of the paper, there are instances in which ink ejected from the nozzles does not land on the paper. As shown in the diagram, when this occurs the supporting member 114 supporting the paper becomes dirty, and as a result the rear surface of the paper becomes dirty. Thus, when printing at the front end of a paper it is desirable for printing to be carried out without making the periphery of the paper dirty.

On the other hand, it is preferable that the paper is printed quickly, even if the front end of the paper is printed.

SUMMARY OF THE INVENTION

It is an object of the present invention to provide a recording apparatus that allows recording to be carried out quickly and without making peripheral areas dirty when recording to the front end of a medium to be recorded without creating margin sections.

An invention for achieving the foregoing object is a recording method for recording by ejecting liquid onto a medium, comprising:

carrying the medium in a carrying direction;

supporting the medium that is carried by a protruding section of a support member having a recessed section and the protruding section; and ejecting the liquid from a plurality of nozzles that are provided in opposition to the recessed section and the protruding section;

wherein:

when recording to a front end, in the carrying direction, of the medium, the medium is carried to position the front end between the recessed section and nozzles that are provided in opposition to the recessed section, and the liquid is ejected from the nozzles that are provided in opposition to the recessed section and nozzles that are provided in opposition to the protruding section.

Features and objects of the present invention other than the above will become clear by reading the description of the present specification with reference to the accompanying drawings.

BRIEF DESCRIPTION OF THE DRAWINGS

FIG. 5 is an explanatory diagram of the configuration of the linear encoder.

FIGS. 6(A)-6(B) are timing charts showing the waveform of an output signal of the linear encoder.

Figure 1:
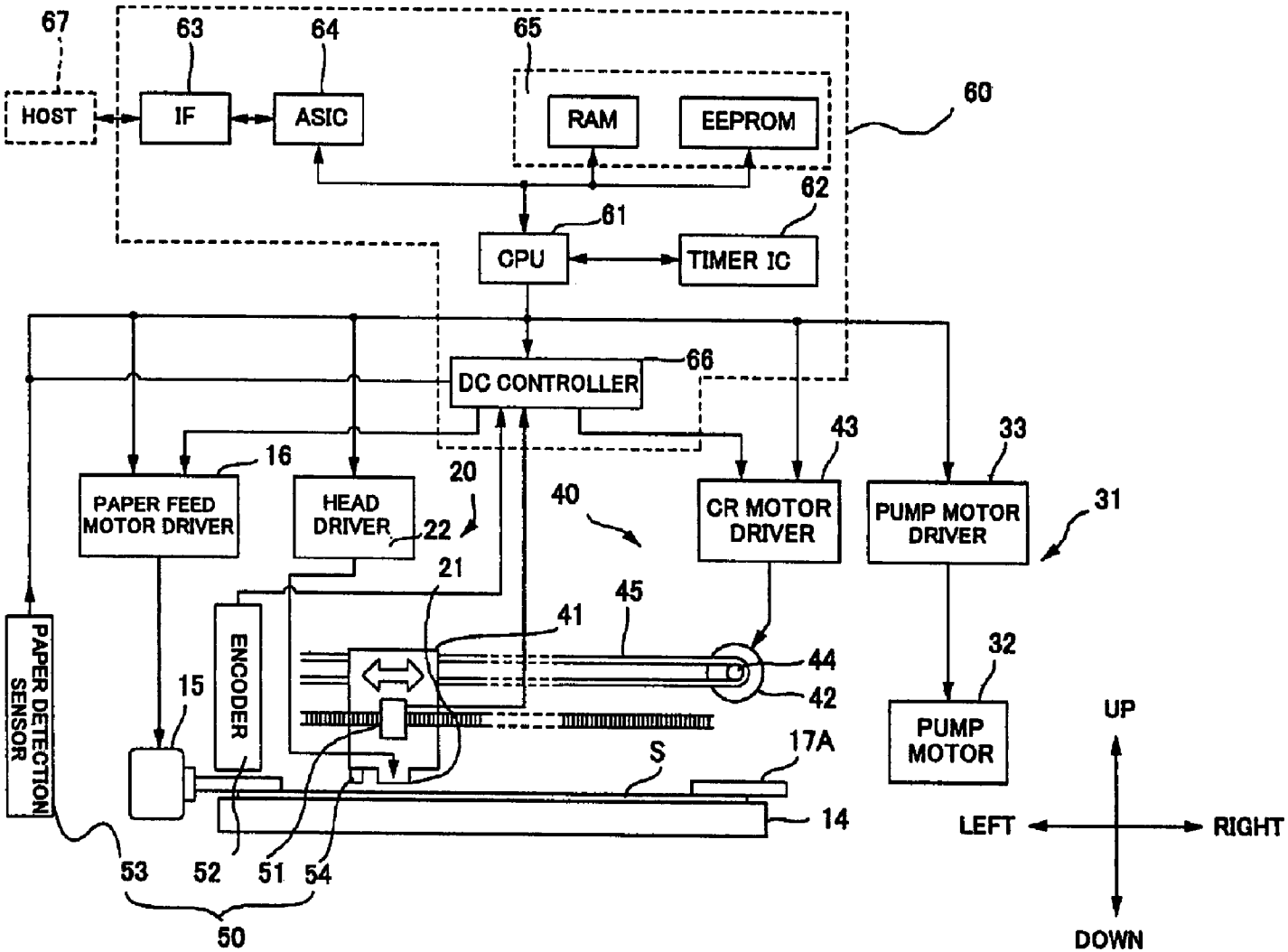
FIG. 1 is an explanatory diagram of the overall configuration of the inkjet printer of the present embodiment.

For a more complete understanding of the present invention and the advantages thereof, reference is now made to the following description taken in conjunction with the accompanying drawings.

DETAILED DESCRIPTION OF THE INVENTION

At least the following matters will be made clear by the explanation in the present specification and the description of the accompanying drawings.

A recording method for recording by ejecting liquid onto a medium, comprises:

carrying the medium in a carrying direction;

supporting the medium that is carried by a protruding section of a support member having a recessed section and the protruding section; and ejecting the liquid from a plurality of nozzles that are provided in opposition to the recessed section and the protruding section;

wherein:

when recording to a front end, in the carrying direction, of the medium, the medium is carried to position the front end between the recessed section and nozzles that are provided in opposition to the recessed section, and the liquid is ejected from the nozzles that are provided in opposition to the recessed section and nozzles that are provided in opposition to the protruding section.

According to this recording method, recording can be carried out quickly and without making peripheral areas dirty when recording to the front end of a medium without creating margin sections.

In the recording method, it is preferable that the front end of the medium is detected, and that the medium is carried based on a result of this detection. Thus, since the front end of the medium can be positioned accurately, the periphery can be kept from becoming dirty due to the liquid that is ejected from the nozzles.

In the recording method, it is preferable that a roller is used to carry the medium, and that the front end of the medium is detected downstream of the roller in the carrying direction. Thus, since the front end of the medium can be positioned accurately, the periphery can be kept from becoming dirty due to the liquid that is ejected from the nozzles.

In the recording method, it is preferable that skew of the medium is corrected, and that the front end of the medium is detected after the skew of the medium is corrected. Thus, since the front end of the medium can be positioned accurately, the periphery can be kept from becoming dirty due to the liquid that is ejected from the nozzles.

In the recording method, it is preferable that the front end of the medium is detected by a detector provided in/on a carriage for moving the nozzles in a scanning direction. Thus, this detector can be used in other applications as well.

In the recording method, it is preferable that the front end of the medium is detected at a position upstream, in the carrying direction, of the nozzles that are provided in opposition to the recessed section.

In the recording method, it is preferable that the recessed section is a groove provided in the support member. It is also preferable that an absorptive body for absorbing the liquid is provided in the recessed section. Thus, the periphery can be kept from becoming dirty even if the liquid that is ejected from the nozzles does not land on the paper.

In the recording method, it is preferable that a carry amount by which the medium is carried when recording to the front end is less than a carry amount by which the medium is carried after recording to the front end is finished. Thus, printing can be divided into a front end process and an ordinary process, and the medium can be carried by a carry amount corresponding to the process.

In the recording method, it is preferable that printing of the medium is carried out by ejecting ink from the nozzles. Thus, when printing to the front end of a medium to be printed, such as paper, without creating a border, printing can be carried out quickly and without making the periphery dirty.

A recording apparatus for carrying out recording to a medium comprises:

a carrying mechanism for carrying a medium in a carrying direction; and a support member that has a recessed section and a protruding section and that supports the medium by the protruding section, wherein a liquid is ejected from a plurality of nozzles that are provided in opposition to the recessed section and the protruding section, and wherein when recording to a front end, in the carrying direction, of the medium to be recorded, the carrying mechanism carries the medium to be recorded, positioning the front end between the recessed section and nozzles that are provided in opposition to the recessed section, and the liquid is ejected from the nozzles that are provided in opposition to the recessed section and nozzles that are provided in opposition to the protruding section. With this recording apparatus, when recording to the front end of a medium without creating margin sections, recording can be carried out quickly and without making peripheral areas dirty.

A computer-readable storage medium, wherein a program stored on the storage medium makes a recording apparatus comprising a carrying mechanism for carrying a medium to be recorded in a carrying direction, and a support member that has a recessed section and a protruding section and that supports the medium to be recorded by the protruding section, wherein liquid is ejected from a plurality of nozzles that are provided in opposition to the recessed section and the protruding section, execute a function of making the carrying mechanism carry the medium to be recorded, positioning a front end, in the carrying direction, of the medium to be recorded between the recessed section and nozzles that are provided in opposition to the recessed section, and a function of ejecting the liquid from the nozzles that are provided in opposition to the recessed section and nozzles that are provided in opposition to the protruding section, when recording to the front end of the medium to be recorded.

With this computer-readable storage medium, when a recording apparatus performs recording to the front end of a medium to be recorded without creating margin sections, the recording apparatus can be controlled so that recording can be carried out quickly and without making peripheral areas dirty.

A printing system comprises:

a main computer unit, and a printing apparatus, wherein the printing apparatus comprises a carrying mechanism for carrying a medium to be recorded in a carrying direction, and a support member that has a recessed section and a protruding section and that supports the medium to be recorded by the protruding section;

wherein liquid is ejected from a plurality of nozzles that are provided in opposition to the recessed section and the protruding section, and wherein when recording to a front end, in the carrying direction, of the medium to be recorded, the carrying mechanism carries the medium to be recorded, positioning the front end between the recessed section and nozzles that are provided in opposition to the recessed section, and the liquid is ejected from the nozzles that are provided in opposition to the recessed section and nozzles that are provided in opposition to the protruding section.

With such a printing system, when recording to the front end of a medium without creating margin sections, recording can be carried out quickly and without making peripheral areas dirty.

===Overview of Printing Apparatus (Inkjet Printer)===

<Regarding the Configuration of the Inkjet Printer>

Figure 2:
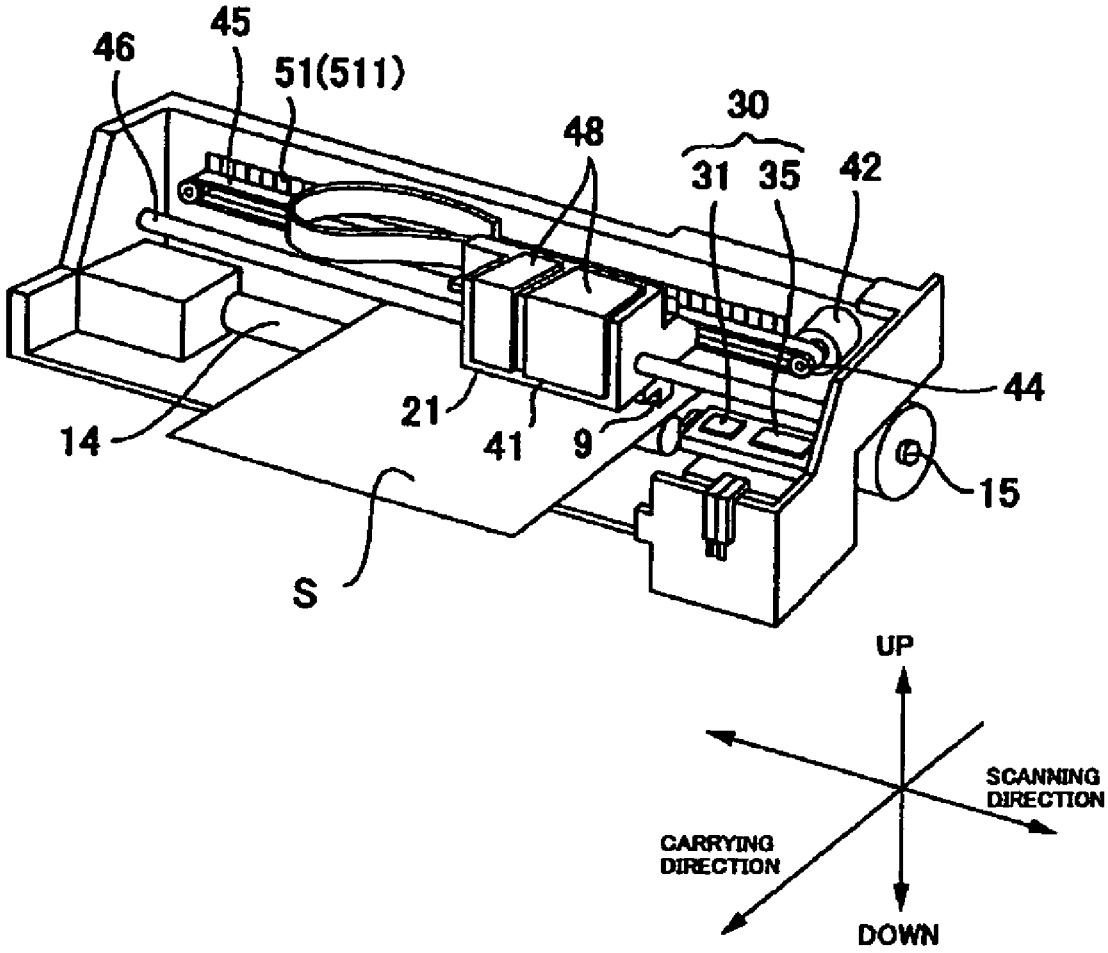
FIG. 2 is a schematic diagram of the periphery of a carriage of the inkjet printer of the present embodiment.
Figure 3:
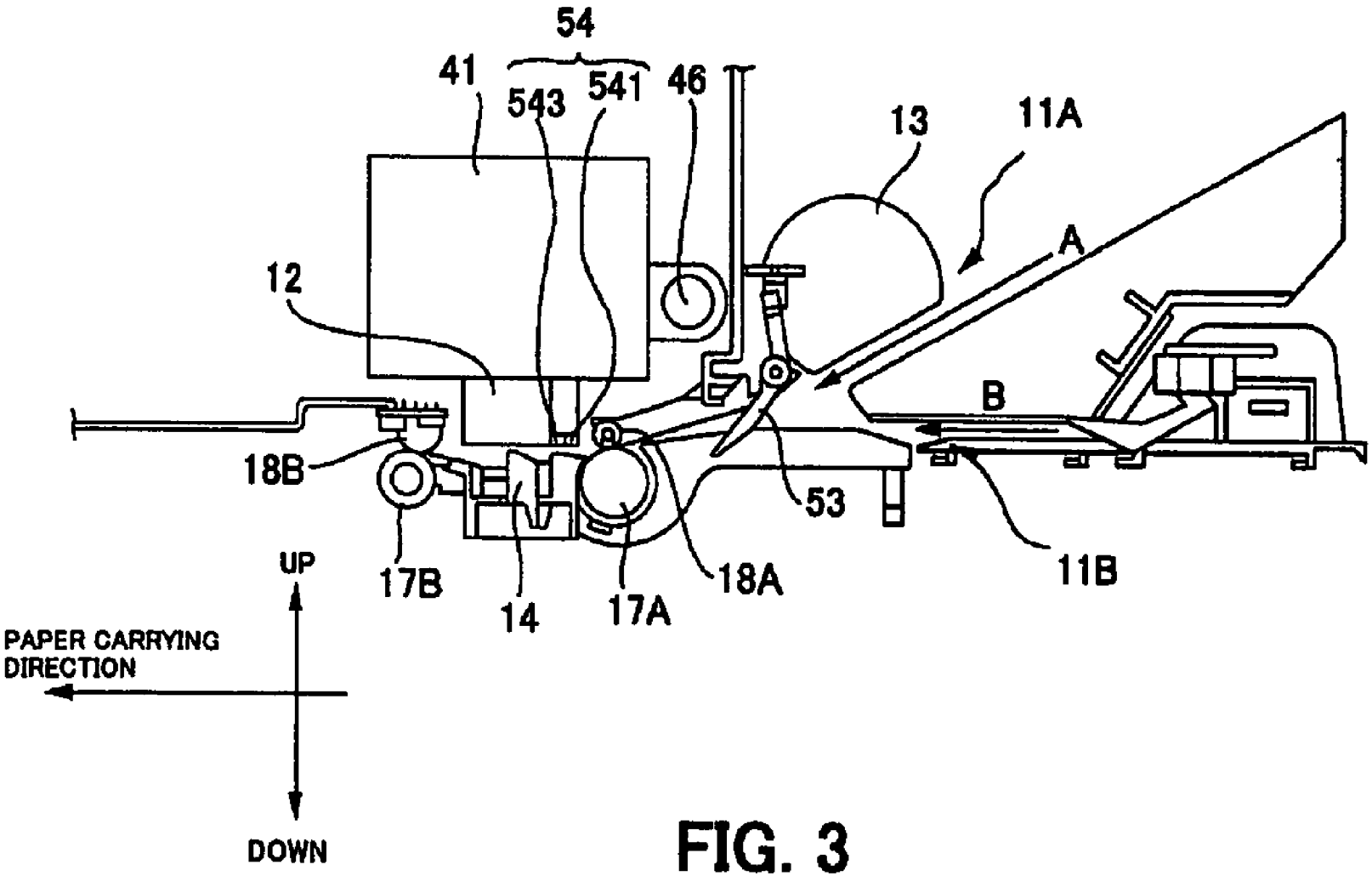
FIG. 3 is an explanatory diagram of the carrying unit area of the inkjet printer of the present embodiment.
Figure 4:
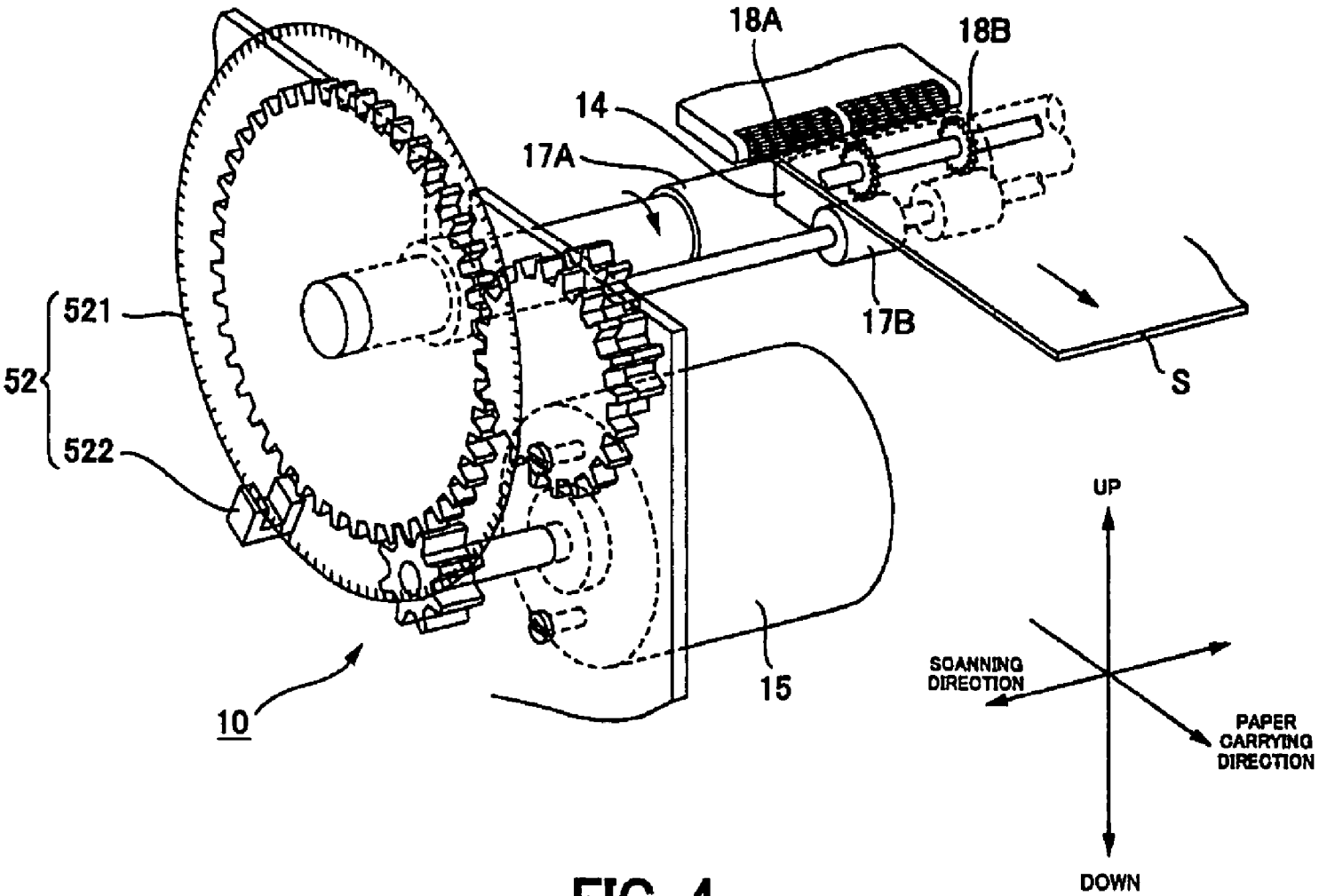
FIG. 4 is a perspective view of the carrying unit area of the inkjet printer of the present embodiment.

An overview of an inkjet printer serving as an example of a printing apparatus is described with reference to FIG. 1, FIG. 2, FIG. 3, and FIG. 4. It should be noted that FIG. 1 is an explanatory diagram of the overall configuration of an inkjet printer of this embodiment, FIG. 2 is a schematic diagram of the periphery of a carriage of the inkjet printer of this embodiment, FIG. 3 is an explanatory diagram of the carrying unit area of the inkjet printer of this embodiment, and FIG. 4 is a perspective view of the carrying unit area of the inkjet printer of this embodiment.

The inkjet printer of this embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, into a printable position and making the paper move in a predetermined direction (the direction perpendicular to the paper face in FIG. 1 (hereinafter, this is referred to as the paper carrying direction)) by a predetermined shift amount during printing. In other words, the paper carrying unit 10 functions as a carrying mechanism for carrying paper. The paper carrying unit 10 has a paper insert opening 11A and a roll paper insert opening 11B, a paper supply motor (not shown), a paper supply roller 13, a platen 14, a paper feed motor (hereinafter, referred to as PF motor) 15, a paper feed motor driver (hereinafter, referred to as PF motor driver) 16, a carry roller 17A and paper discharge rollers 17B, and free rollers 18A and free rollers 18B. However, the paper carrying unit 10 does not necessarily have to include all of these structural elements in order to function as a carrying mechanism.

The paper insert opening 11A is where paper, which is a medium to be printed, is inserted. The paper supply motor (not shown) is a motor for carrying the paper that has been inserted into the paper insert opening 11A into the printer, and is constituted by a pulse motor. The paper supply roller 13 is a roller for automatically carrying the paper that has been inserted into the paper insert opening 11A into the printer, and is driven by the paper supply motor 12. The paper supply roller 13 has a transverse cross-sectional shape that is substantially the shape of the letter D. The peripheral length of a circumference section of the paper supply roller 13 is set longer than the carrying distance to the PF motor 15, so that using this circumference section the medium to be printed can be carried up to the PF motor 15. It should be noted that a plurality of media to be printed are kept from being supplied at one time by the rotational drive force of the paper supply roller 13 and the friction resistance of separating pads (not shown). The sequence through which the medium to be printed is carried is described in detail later.

The platen 14 is a support member (support means) that supports the paper S during printing. The configuration of the platen 14 is described in detail later. The PF motor 15 is a motor for feeding paper, which is an example of a medium to be printed, in the paper carrying direction, and is constituted by a DC motor. The PF motor driver 16 is for driving the PF motor 15. The carry roller 17A is a roller for feeding the paper S that has been carried into the printer by the paper supply roller 13 to a printable region, and is driven by the PF motor 15. The free rollers 18A are provided in a position that is in opposition to the carry roller 17A, and push the paper S toward the carry roller 17A by sandwiching the paper S between them and the carry roller 17A.

The paper discharge rollers 17B are rollers for discharging the paper S for which printing has finished to outside the printer. The paper discharge rollers 17B are driven by the PF motor 15 through a gear wheel that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The ink ejection unit 20 is for ejecting ink onto paper, which is an example of the medium to be printed. The ink ejection unit 20 has a head 21 and a head driver 22. The head 21 has a plurality of nozzles, which are ink ejection sections, and ejects ink intermittently from each of the nozzles. The head driver 22 is for driving the head 21 so that ink is ejected intermittently from the head.

The cleaning unit 30 is for keeping the nozzles of the head 21 from becoming clogged. The cleaning unit 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from clogging.

The carriage unit 40 is for making the head 21 scan and move in a predetermined direction (in FIG. 1, the left to right direction of the paper face (hereinafter, this is referred to as the scanning direction)). The carriage unit 40 has a carriage 41, a carriage motor (hereinafter, referred to as CR motor) 42, a carriage motor driver (hereinafter, referred to as CR motor driver) 43, a pulley 44, a timing belt 45, and a guide rail 46. The carriage 41 can be moved in the scanning direction, and the head 21 is fastened to it (thus, the nozzles of the head 21 intermittently eject ink as they are moved in the scanning direction). The carriage 41 also removably holds an ink cartridge 48 that accommodates ink. The CR motor 42 is a motor for moving the carriage in the scanning direction, and is constituted by a DC motor. The CR motor driver 43 is for driving the CR motor 42. The pulley 44 is attached to the rotation shaft of the CR motor 42. The timing belt 45 is driven by the pulley 44. The guide rail 46 is for guiding the carriage 41 in the scanning direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the carry roller 17A. It should be noted that the configuration, for example, of the encoders is discussed later. The paper detection sensor 53 is for detecting the position of the front end of the paper to be printed. The paper detection sensor 53 is provided in a position where it can detect the position of the front end of the paper as the paper is being carried toward the carry roller 17A by the paper supply roller 13. It should be noted that the paper detection sensor 53 is a mechanical sensor that detects the front end of the paper through a mechanical mechanism. More specifically, the paper detection sensor 53 has a lever that can be rotated in the paper carrying direction, and this lever is arranged so that it protrudes into the path over which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 41. The paper width sensor 54 is an optical sensor having a light-emitting section 541 and a light-receiving section 543, and detects whether the paper exists or not in the position of the paper width sensor 54 by detecting light that is reflected by the paper. The paper width sensor 54 detects the position of the edge of the paper while being moved by the carriage 41, so as to detect the width of the paper. The paper width sensor 54 can detect the front end of the paper by the position of the carriage 41; The paper width sensor 54 is an optical sensor, and thus detects positions with higher precision than the paper detection sensor 53.

The control unit 60 is for carrying out control of the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals for the CPU 61. The interface section 63 exchanges data with a host computer 67 provided outside the printer. The ASIC 64 controls the printing resolution and the drive waveforms of the head, for example, based on printing information sent from the host computer 67 through the interface section 63. The memory 65 is for reserving an area for storing the programs for the ASIC 64 and the CPU 61 and a working storage, for instance, and has storage members (storage means) such as a RAM or an EEPROM. The DC controller 66 controls the PF motor driver 16 and the CR motor driver 43 based on control commands sent from the CPU 61 and the output from the measuring instrument group 50.

<Regarding the Configuration of the Encoders>

FIG. 5 is an explanatory diagram of the linear encoder 51.

The linear encoder 51 is for detecting the position of the carriage 41, and has a linear scale 511 and a detection section 512.

The linear scale 511 is provided with slits at a predetermined spacing (for example, every 1/180 inch (1 inch equals 2.54 cm)), and is fastened to the main printer unit.

The detection section 512 is provided in opposition to the linear scale 511, and is on the carriage 41 side. The detection section 512 has a light-emitting diode 512A, a collimating lens 512B, and a detection processing section 512C. The detection processing section 512C is provided with a plurality of (for instance, four) photodiodes 512D, a signal processing circuit 512E, and two comparators 512Fa and 512Fb.

The light-emitting diode 512A emits light when a voltage Vcc is applied to it via resistors on both sides, and this light is incident on the collimating lens. The collimating lens 512B turns the light that is emitted from the light-emitting diode 512A into parallel light, and irradiates the parallel light on the linear scale 511. The parallel light that passes through the slits provided in the linear scale then passes through stationary slits (not shown) and is incident on the photodiodes 512D. The photodiodes 512D convert the incident light into electrical signals. The electrical signals that are output from the photodiodes are compared in the comparators 512Fa and 512Fb, and the results of these comparisons are output as pulses. Then, the pulse ENC-A and the pulse ENC-B that are output from the comparators 512Fa and 512Fb become the output of the linear encoder 51.

FIG. 6 is a timing chart showing the waveforms of the two types of output signals of the linear encoder 51. FIG. 6A is a timing chart of the waveform of the output signal of the linear encoder 51 when the CR motor 42 is rotating forward. FIG. 6B is a timing chart of the waveform of the output signal of the linear encoder 51 when the CR motor 42 is rotating in reverse.

As shown in FIG. 6A and FIG. 6B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, then, as shown in FIG. 6A, the phase of the pulse ENC-A leads the phase of the pulse ENC-B by 90 degrees. On the other hand, when the CR motor 42 is rotating in reverse, then, as shown in FIG. 6B, the phase of the pulse ENC-A is delayed by 90 degrees with respect to the phase of the pulse ENC-B. A single period T of the pulses is equivalent to the time during which the carriage 41 is moved by the spacing of the slits of the linear scale 511 (for example, by 1/180 inch (1 inch equals 2.54 cm)).

The position of the carriage 41 is detected as follows. First, the rising edge or the falling edge of either the pulse ENC-A or ENC-B is detected, and the number of detected edges is counted. The position of the carriage 41 is calculated based on the counted number. With respect to the counted number, when the CR motor 42 is rotating forward a "+1" is added for each detected edge, and when the CR motor 42 is rotating in reverse a "−1" is added for each detected edge. Since the period of the pulses ENC is equal to the slit spacing of the linear scale 511, when the counted number is multiplied by the slit spacing, the amount that the carriage 41 has moved from when the count number is "0" can be obtained. In other words, the resolution of the linear encoder 51 in this case is the slit spacing of the linear scale 511. It is also possible to detect the position of the carriage 41 using both the pulse ENC-A and the pulse ENC-B. The periods of the pulse ENC-A and the pulse ENC-B are equal to the slit spacing of the linear scale 511, and the phases of the pulses ENC-A and ENC-B are misaligned by 90 degrees, so that if the rising edges and the falling edges of the pulses are detected and the number of detected edges is counted, then a counted number of "1" corresponds to ¼ of the slit spacing of the linear scale 511. Therefore, if the counted number is multiplied by ¼ of the slit spacing, then the amount that the carriage 41 has moved from when the count number was "0" can be obtained. That is, the resolution of the linear encoder 51 in this case is ¼ the slit spacing of the linear scale 511.

The velocity Vc of the carriage 41 is detected as follows. First, the rising edges or the falling edges of either the pulse ENC-A or ENC-B are detected. The time interval between edges of the pulses is counted with a timer counter. The period T (T=T1, T2, . . . ) is obtained from the value that is counted. Then, when the slit spacing of the linear scale 511 is regarded as λ, the velocity of the carriage can be sequentially obtained as λ/T. It is also possible to detect the velocity of the carriage 41 using both the pulse ENC-A and the pulse ENC-B. By detecting the rising edges and the falling edges of the pulses, the time interval between edges, which corresponds to ¼ of the slit spacing of the linear scale 511, is counted by the timer counter. The period T (T=T1, T2, . . . ) is obtained from the value that is counted. Then, when the slit spacing of the linear scale 511 is regarded as λ, the velocity Vc of the carriage can be found sequentially as Vc =λ/(4T).

It should be noted that the rotary encoder 52 has substantially the same configuration as the linear encoder 51, except that a rotation disk 521 that rotates in conjunction with rotation of the carry roller 17A is used in place of the linear scale 511 that is provided on the main printer unit, and that a detection section 522 provided on the main printer unit is used in place of the detection section 512 that is provided on the carriage 41 (see FIG. 4).

It should be noted that the rotary encoder 52 directly detects the rotation amount of the carry roller 17A, and does not detect the carry amount of the paper. However, when the carry roller 17A is rotated to carry the paper, a carry error occurs due to slippage between the carry roller 17A and the paper. Consequently, the rotary encoder 52 cannot directly detect the carry error of the carry amount of the paper. Accordingly, a table that expresses the relationship between the rotation amount detected by the rotary encoder 52 and the carry error is created and stored in the memory 65 of the control unit 60. Then, the table is referenced based on the results detected by the rotary encoder, and the carry error is detected. This table is not limited to expressing the relationship between the rotation amount and the carry error, and may also be a table that expresses the relationship between the number of times of carries, for example, and the carry error. Also, because slippage differs depending on the characteristics of the paper, it is also possible to create a plurality of tables corresponding to the paper characteristics and to store these in the memory 65.

<Configuration of the Nozzles>

Figure 7:
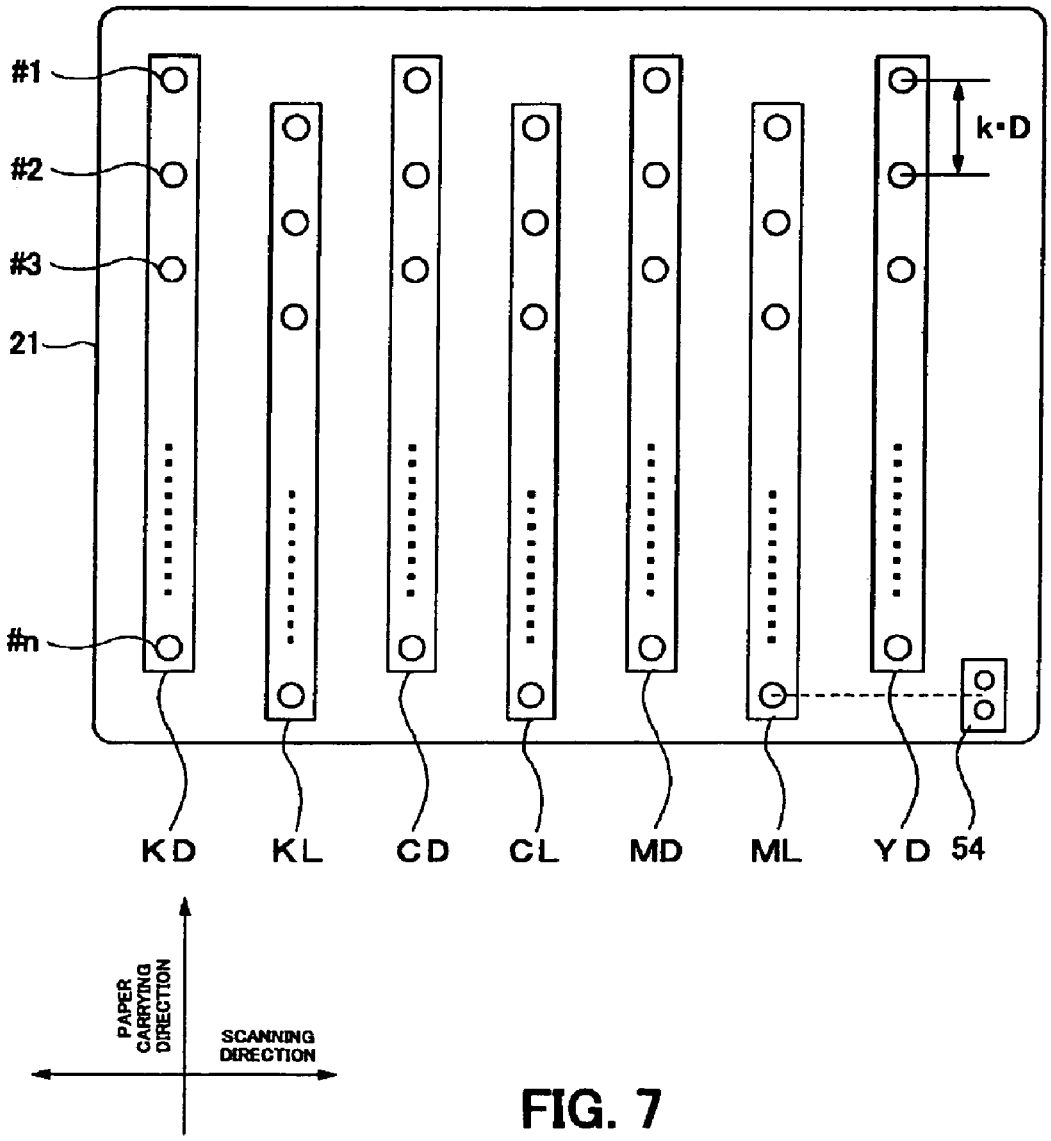
FIG. 7 is an explanatory diagram showing the arrangement of the nozzles.

FIG. 7 is an explanatory diagram showing the arrangement of the nozzles in the lower surface of the head 21. In the lower surface of the head 21 there are formed a dark black ink nozzle group KD, a light black ink nozzle group KL, a dark cyan ink nozzle group CD, a light cyan ink nozzle group CL, a dark magenta ink nozzle group MD, a light magenta nozzle group ML, and a yellow ink nozzle group YD. Each nozzle group is provided with a plurality (in this embodiment, n) of nozzles, which are ejection openings for ejecting the various colors of ink. It should be noted that the first alphabet letter in the reference characters indicating the nozzle groups represents the ink color, whereas the accompanying letter "D" means that the ink is of relatively high concentration and the accompanying letter "L" means that the ink is of relatively low concentration.

The plurality of nozzles of the nozzle groups are arranged at a constant spacing (nozzle pitch: k·D) in the paper carrying direction. Here, D is the minimum dot pitch in the paper carrying direction (that is, the spacing at the highest resolution of the dots formed on the paper S). Also, k is an integer of 1 or more.

The nozzles of the nozzle groups are assigned numbers that become smaller toward the downstream side (#1 to #n). Also, as regards their positions in the paper carrying direction, the nozzles of each nozzle group are provided so that they are positioned between the nozzles of adjacent nozzle groups. For example, the first nozzle #1 of the light black ink nozzle group KL is provided between the first nozzle #1 and the second nozzle #2 of the dark black ink nozzle group KD, as regards its position in the paper carrying direction. Also, the paper width sensor 54 is provided substantially in the same position as the nth nozzle #n furthest downstream, as regards its position in the paper carrying direction. Each nozzle is provided with a piezo element (not shown) as a drive element for driving the nozzle and making it eject ink droplets.

It should be noted that during printing, the paper S is carried intermittently by the paper carrying unit 10 by a predetermined carry amount, and between these intermittent carries the carriage 41 is moved in the main-scanning direction and ink droplets are ejected from the nozzles.

===Paper Carry Sequence===

Figure 8:
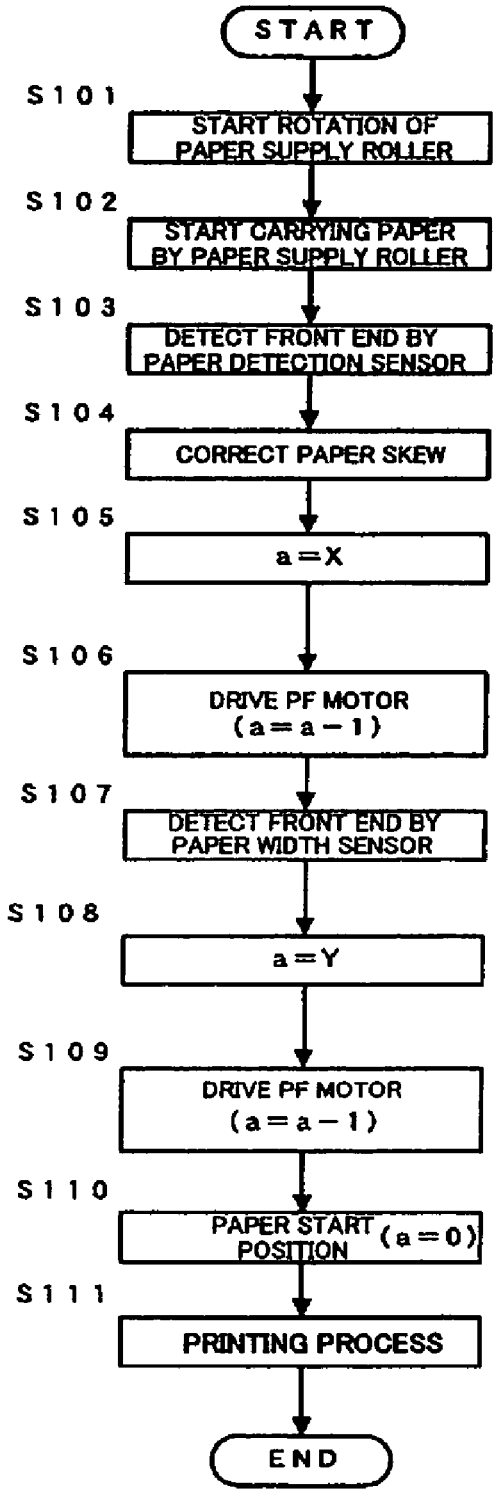
FIG. 8 is a flowchart showing the sequence through which paper is carried.

FIG. 8 is a flowchart showing the sequence in which paper is carried. It should be noted that this sequence is executed by the control unit 60. Also, FIG. 9 is a diagram showing the positional relationship between the paper and the various structural elements when the paper is carried up to the print start position. It should be noted that FIG. 9 is a diagram in which the structural elements are viewed from above, and the direction toward the bottom of the diagram is the paper carrying direction. The structural elements are assigned the same reference numerals as those used in the foregoing description, and thus description of the structural elements is omitted.

Figure 9A:
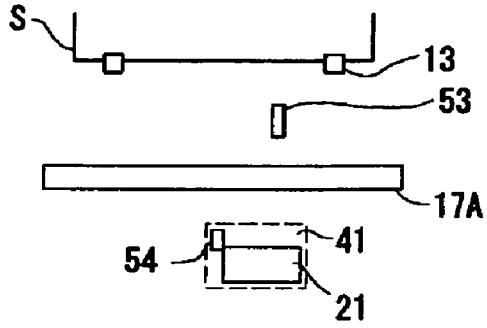
FIGS. 9(A)-9(F) are diagrams showing the positional relationship between the structural components and the paper when carrying the paper up to the print start position.

First, rotation of the paper supply roller 13 starts when a print command is given to the printer (S101). The initial position of the paper S is as shown in FIG. 9A. It should be noted that a plurality of the paper S are prevented from being supplied at one time by the rotational drive force of the paper supply roller 13 and the friction resistance of the separating pads (not shown).

Figure 9B:
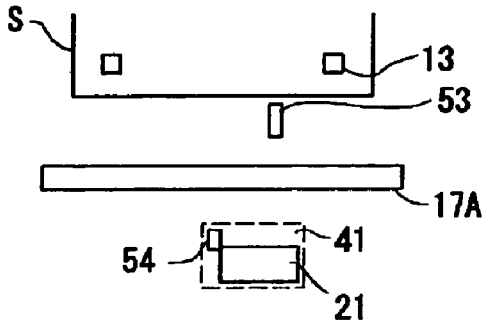

Next, the paper S is carried in the paper carrying direction by the paper supply roller 13 (S102). The position of the paper S at this time is as shown in FIG. 9B. It should be noted that the peripheral length of the circumference section of the paper supply roller 13 is set longer than the carrying distance to the PF motor 15, so that using this circumference section the medium to be printed can be carried up to the PF motor 15.

Figure 9C:
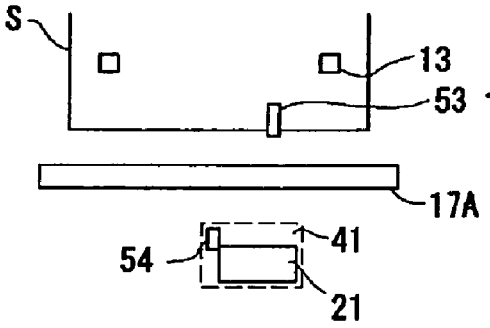

Next, the position of the front end of the paper S is detected by the paper detection sensor 53 (S103). That is, it can be detected that the front end of the paper S has arrived at the position of the paper detection sensor 53 by detecting the rotation of the lever of the paper detection sensor 53 when the front end of the paper S comes into contact with the lever. The position of the paper S at this time is as shown in FIG. 9C.

Figure 10:
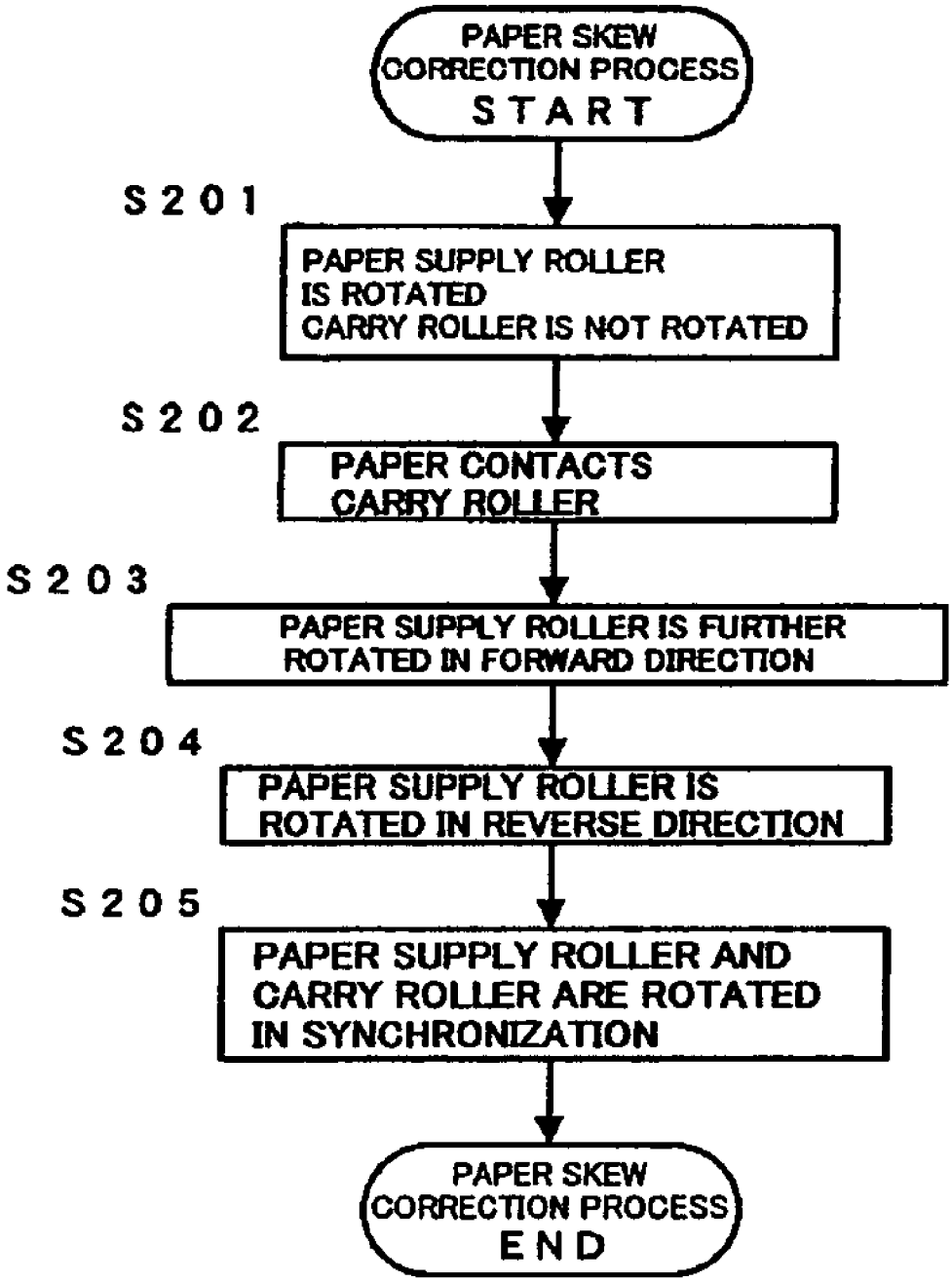
FIG. 10 is a flow of paper skew correction.
Figure 11A:
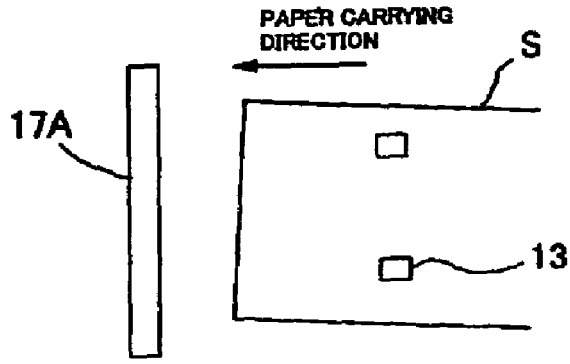
FIGS. 11(A)-11(D) are diagrams of the appearance of paper skew correction seen from above.
Figure 11B:
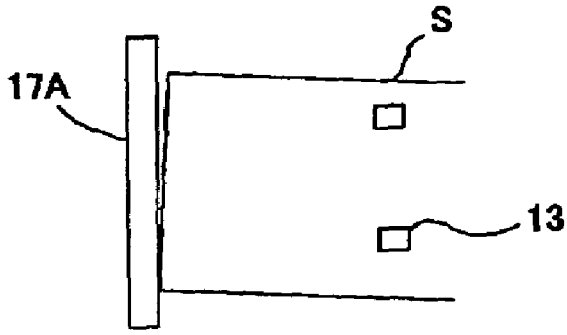
Figure 11C:
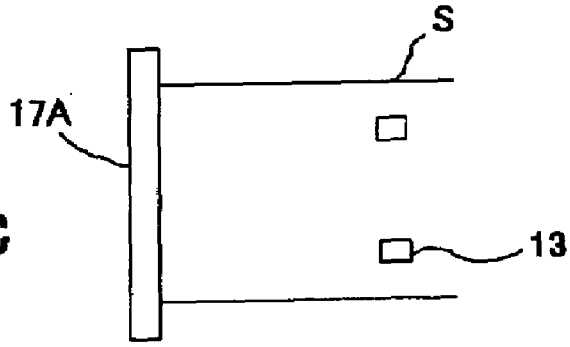
Figure 11D:
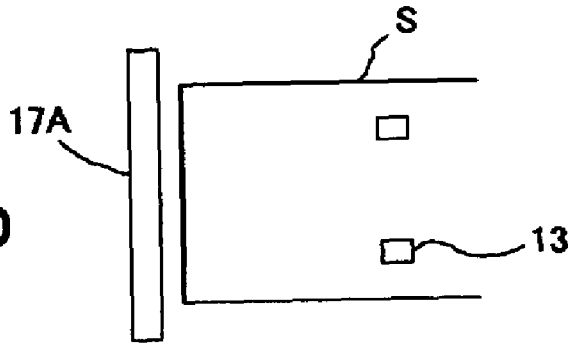

Next, skew of the paper is corrected (S104). The process for correcting paper skew is described using FIG. 10 and FIG. 11. It should be noted that FIG. 10 is a flowchart for correction of paper skew, and FIG. 11 is a diagram seen from above of how paper skew correction is carried out. First, with rotation of the carry roller 17A in a stopped state, the paper supply roller 13 is rotated in the forward direction (the rotation direction in which the paper is carried in the paper carrying direction), carrying the paper S in the paper carrying direction (S201, FIG. 11A). Next, the paper S is brought into contact with the carry roller 17A (S202, FIG. 11B). Then, the paper supply roller 13 is further moved in the forward direction by a predetermined amount (S203). At this time, the paper S is not carried because the carry roller 17A is stopped, and thus slippage occurs between the paper supply roller 13 and the paper S, making the front end of the paper S parallel with the carry roller 17A (FIG. 1C). Next, the paper supply roller 13 is rotated in reverse, separating the paper S from the carry roller 17A (S204, FIG. 1D). Then, rotation of the carry roller 17A is started in order to carry the paper S. At this time, the paper supply roller 13 and the carry roller 17A are rotated in synchronization with one another so that the amount the paper is carried by the paper supply roller 13 and the amount the paper is carried by the carry roller 17A are the same (S205). By performing the above process, skew of the paper can be corrected before the paper is carried. It should be noted that the amount that the paper supply roller 13 is rotated in the above process for correcting paper skew is controlled based on the position of the front end of the paper that is detected by the paper detection sensor 53.

Figure 9D:
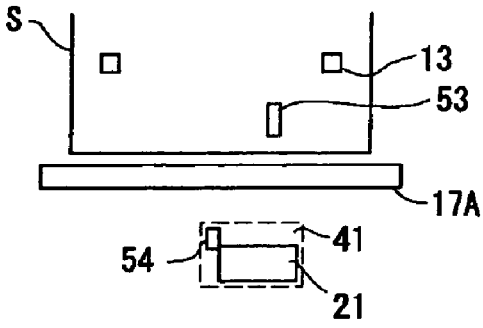
Figure 9E:
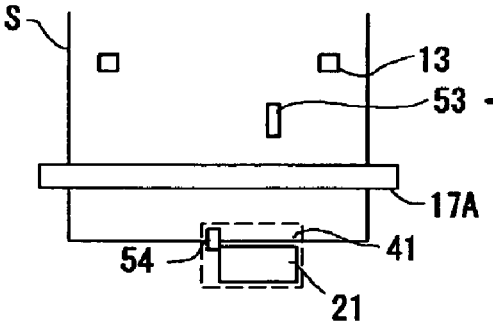
Figure 9F:
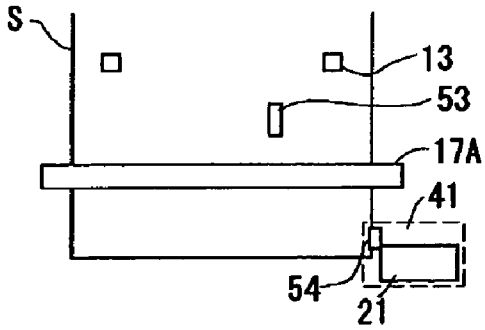

Next, in order to adjust the settings so that the paper S is carried from the state shown in FIG. 9D (FIG. 11D) by a predetermined paper carry amount X, the value of the counter, which is not shown, is set to X (S105), the PF motor 15 is rotated to reduce the value of the counter based on the pulse signal from the rotary encoder 52 (S106), and the PF motor 15 is driven until it has carried the paper by the predetermined paper carry amount X (S108).

When the front end of the paper S is detected by the paper width sensor 54 as the paper S is being carried by the paper carry amount x (FIG. 9E) (S107), the setting for the remaining paper carry amount is changed and the value of the counter is set so that the paper S is carried by a predetermined paper carry amount Y (S108). In other words, the setting for the carry amount that was set based on the results of the detection by the paper detection sensor 53 is changed based on the results of the detection by the paper width sensor 54. Then, the PF motor 15 is rotated to reduce the value of the counter based on the pulse signal from the rotary encoder 52 (S109), and the PF motor 15 is driven until it has carried the paper by the paper carry amount Y (S110, FIG. 9F). It should be noted that in FIG. 9F, the location of the carriage 41 has been moved so that the edge of the paper is detected by the paper width sensor 54.

The position of the paper S when the paper S has been carried by the paper carry amount Y (when the counter is a=0) as described above is referred to as the "print start position." By carrying the paper S by a predetermined carry amount from this print start position, the paper S is carried up to the printing position, and printing is started (S111).

In this embodiment, the front end of the paper S is detected by the paper width sensor 54 and the paper carry amount is set based on the results of the detection by the paper width sensor 54. That is, in this embodiment the paper S is carried based on the results of the detection by the paper width sensor 54. Consequently, in this embodiment the paper S is carried up to the printing position with high positional accuracy.

Also, in this embodiment, the paper width sensor 54 is provided more downstream than the carry roller. Thus, even if the paper S slips when it comes into contact with the carry roller, the front end of the paper S is detected after it has slipped, and thus if the paper S is carried in accordance with the results of this detection, it can be carried with high positional accuracy.

Also, in this embodiment, the front end of the paper is detected by the paper width sensor 54 after paper skew has been corrected. Thus, the position of the front end of the paper is detected accurately, so that if the paper S is carried based on the results of the detection by the paper width sensor, the paper S can be carried with high positional accuracy.

===Configuration of the Platen===

Figure 12:
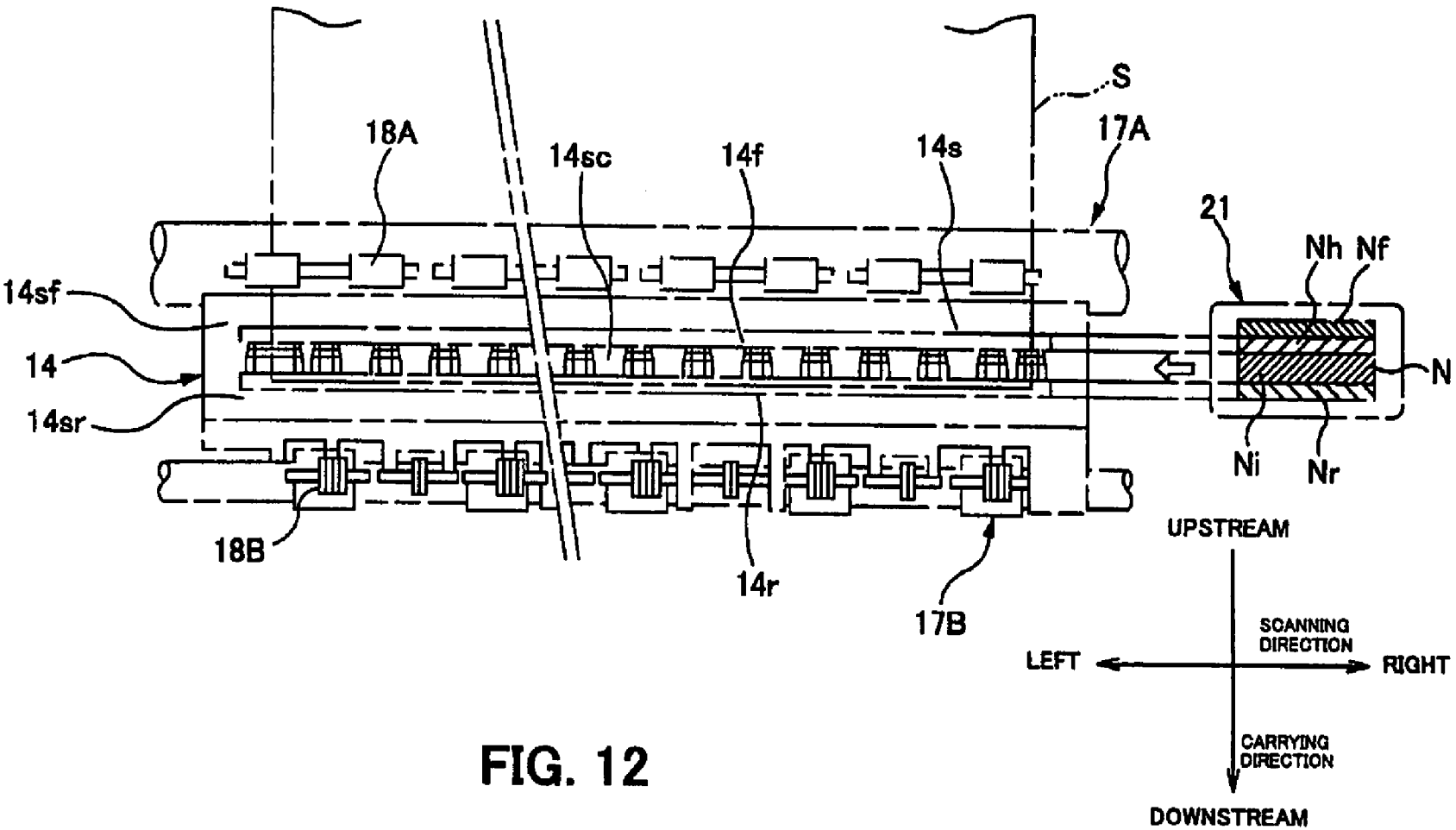
FIG. 12 is an explanatory diagram showing the positional relationship between the grooves and the nozzle groups.

FIG. 12 is an explanatory diagram showing the positional relationship between the grooves provided in the platen and the nozzle groups. Previously described structural components are assigned identical numbers in the diagram, and description thereof is omitted.

The platen 14 has recessed sections and protruding sections. For the recessed sections, the platen 14 has two grooves formed in the scanning direction. Of these two grooves, the groove on the upstream side is referred to as the upstream side groove 14*f* and the groove on the downstream side is referred to as the downstream side groove 14*r*. These grooves are formed in the platen 14 such that in the scanning direction they are longer than the width of the paper S. These grooves are also provided with an absorptive body for absorbing ink.

Also, as the protruding sections, the platen 14 has an upstream side support section 14*sf*, a central support section 14*sc*, and a downstream side support section 14*sr*. These support sections support the paper S in such a manner that it is in opposition to the head 21. The upstream side support section 14*sf* supports the paper S upstream of the upstream side groove 14*f*, and also supports the paper S between the carry roller 17A and the upstream side groove 14*f*. The central support section 14*sc* supports the paper S between the upstream side groove 14*f* and the downstream side groove 14*r*. The downstream side support section 14*sr* supports the paper S downstream of the downstream side groove 14*r* and also supports the paper S between the paper discharge rollers 17B and the downstream side groove 14*r*.

The various color nozzle groups of the head 21 each have an upstream side nozzle group Nf, an upstream side supra-groove nozzle group Nh, a central nozzle group Ni, and a downstream side supra-groove nozzle group Nr. The upstream side nozzle group Nf is a nozzle group provided in a position that is in opposition to the upstream side support section sf, and in this reference example, the nozzles #35 to #48 are the upstream side nozzle group. The upstream side supra-groove nozzle group Nh is a nozzle group provided in a position that is in opposition to the upstream side groove 14*f*, and in this reference example, the nozzles #31 to #34 are the upstream side supra-groove nozzle group. The central nozzle group Ni is a nozzle group provided in a position that is in opposition to the central support section 14*sc*, and in this reference example, the nozzles #6 to #30 are the central nozzle group. The downstream side supra-groove nozzle group Nr is a nozzle group provided in a position that is in opposition to the downstream side groove 14*r*, and in this reference example, the nozzles #1 to #5 are the downstream side supra-groove nozzle group. It should be noted that in the diagram each of the nozzle groups are provided in the region shown by the oblique line.

By moving the carriage 41 in the scanning direction, the head 21 is also moved in the scanning direction. Since the upstream side groove 14*f* and the downstream side groove 14*r* are formed in the scanning direction, it is possible for the nozzle group Nh to remain in opposition to the upstream side groove 14*f* while moving and for the nozzle group Nr to remain in opposition to the downstream side groove 14*r* while moving. Even if ink were ejected from the nozzle group Nh without there being a paper S, the ink that is ejected would still land in the upstream side groove 14*f*, and thus the support sections of the platen would not become dirty, so that later the rear surface of the paper that is carried would not become dirty. Likewise, even if ink were ejected from the nozzle group Nr without there being a paper S on the platen, the ink that is ejected would still land in the downstream side groove 14*r*, and thus the support sections of the platen would not become dirty, so that later the rear surface of the paper that is carried would not become dirty. Moreover, since an ink absorptive body is provided in each of these grooves, the ink that lands in the grooves is absorbed by the ink absorptive bodies, and thus the rear surface of the paper is kept from becoming dirty due to splattering of the ink.

===Method for Printing Front End of the Paper===

<Reference Example>

Figure 13:
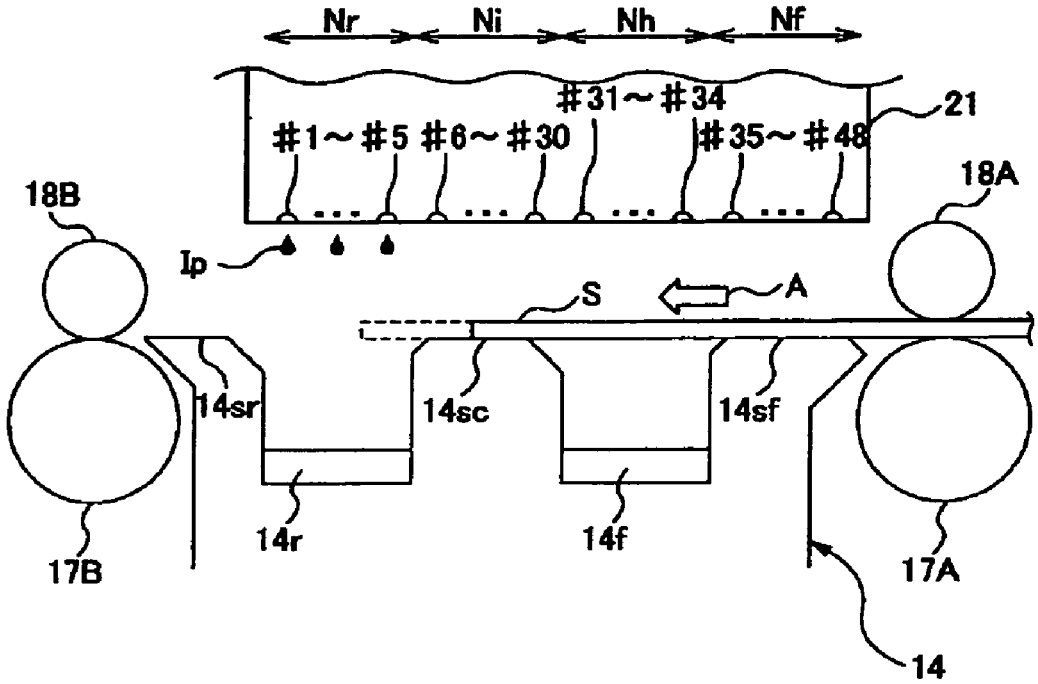
FIG. 13 is an explanatory diagram showing a method for printing the front end of a paper according to a reference example.

FIG. 13 is an explanatory diagram showing a method for printing the front end of the paper according to a reference example.

With the printing method of this reference example, first, the paper detection sensor 53 (not shown in FIG. 13) upstream of the carry roller 17A is used to detect the front end of the paper. Then, based on the results of the detection by the paper detection sensor 53, position determination is performed (the so-called print start positioning operation) so that the front end of the paper is positioned on the central support section 14*sc* of the platen 14. Then, the paper S is intermittently carried in very small increments, and between these intermittent carries, ink is ejected from only the nozzle group Nr so as to perform printing of the front end of the paper.

In the printing method of this reference example, the front end of the paper is detected upstream of the carry roller 17A, and thus when the front end of the paper is positioned on the platen the paper is carried including a relatively large carry error. Also, in the printing method of this reference example, the reason the print start position is on the central support section 14*sc* of the platen 14 is that when the print start position is set further downstream than that, the carry error causes the front end of the paper to be positioned downstream of the downstream side groove 14*r*, and the front end of the paper can no longer be printed.

Also, in the printing method of this reference example, the reason why only the nozzle group Nr is used when printing the front end of the paper is because the carry error causes the front end of the paper S to be positioned on the central support section 14*sc* of the platen 14 when the print start positioning operation is over. That is, even under these conditions, the ink droplets Ip land on the downstream side groove 14*r* if the nozzle group Nr is used, and thus the support sections of the platen do not become dirty. Another reason is that under these conditions, the platen becomes dirty when ink is ejected from nozzle #6, for example.

However, with the method for printing the front end according to this reference example, since few nozzles are used when printing the front end, the print region when printing the front end is narrow and the print time is long.

<Printing Method of the Present Embodiment>

Figure 14:
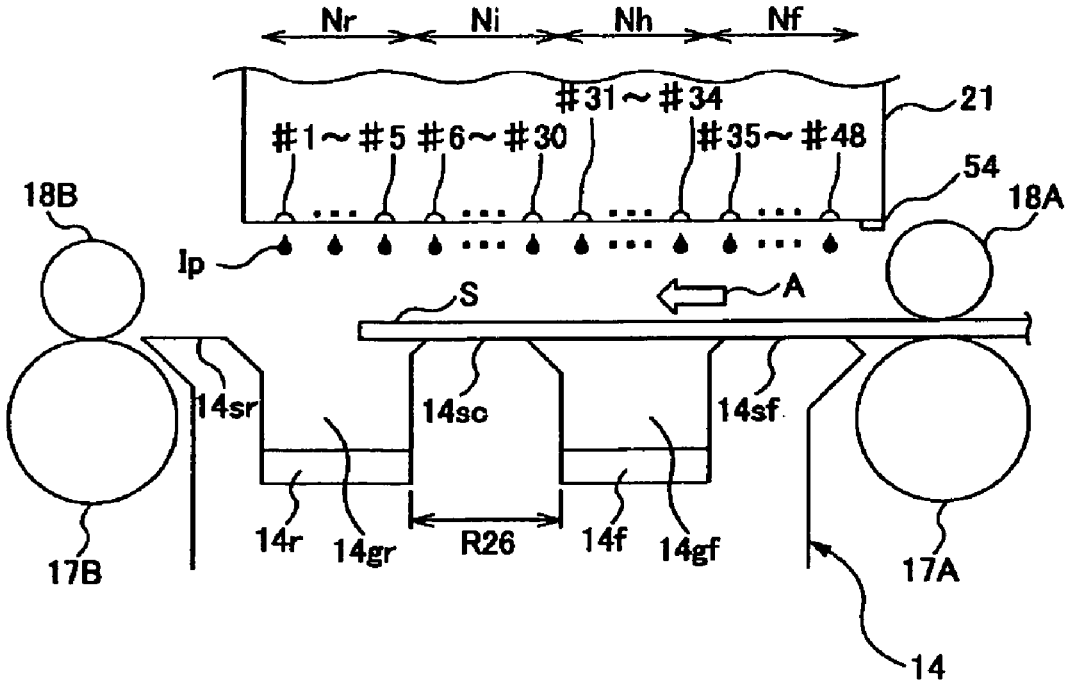
FIG. 14 is an explanatory diagram showing a method for printing the front end of a paper according to the present embodiment.

FIG. 14 is an explanatory diagram of the method for printing the front end of a paper according to this embodiment. In the diagram, previously described structural components are assigned identical numbers, and thus a description thereof is omitted. It should be noted that the positional relationship between the grooves and the nozzle groups in this embodiment is the same as in the reference example.

In this embodiment, as described above, the paper width sensor 54 downstream of the carry roller 17A is used to detect the front end of the paper, and the paper S is carried based on the results of that detection. Consequently, the paper S can be carried with high positional precision.

Also, in this embodiment, the paper is carried based on the results of the detection by the paper width sensor 54, positioning the front end of the paper above the downstream side groove 14*r* (the front end of the paper is positioned between the downstream side groove 14*r* and the nozzle group Nr). It should be noted that with the printing method of this embodiment, the front end of the paper is detected downstream of the carry roller 17A, and thus the front end of the paper can be more accurately positioned than in a case where the front end of the paper is detected on the upstream side of the carry roller 17A like in the reference example. Also, since the front end of the paper can be positioned accurately, it is possible to perform the print start positioning operation such that the front end of the paper is positioned above the downstream side groove 14*r* of the platen 14.

Then, with the printing method of this embodiment, after the paper has been carried to the above-described position, printing is carried out using not only the nozzle group Nr but also the nozzles upstream of that nozzle group (the nozzle group Ni, the nozzle group Nh, and the nozzle group Nf). In this embodiment, since the print start position of the paper front end is above the downstream side groove 14*r*, the ink droplets $I_p$ land on the paper even if ink is ejected from the nozzles upstream of the nozzle group Nr, and thus the support sections of the platen are kept from becoming dirty.

Also, in this embodiment the paper width sensor is provided upstream of the downstream side supra-groove nozzle group Nr, and thus the front end of the paper S can be detected before the front end of the paper S is printed by the downstream side supra-groove nozzle group Nr. Consequently, the paper can be carried to the above-described position using the results of the detection by the paper width sensor.

===Regarding the Paper Carry Amount===

Next, the carrying methods for various printing formats (print modes) in a case where each nozzle group has 48 nozzles and the nozzle pitch (spacing between nozzles) is 1/180 inch are described. The positional relationship between the grooves and the nozzle groups is as described earlier. Here, for the sake of simplifying the description, the print mode for a single nozzle group is described, but this print mode applies to the nozzle groups for other colors as well. In the explanatory diagram shown below, for convenience sake the nozzles are illustrated moving with respect to the paper S. However, in practice the paper S is moved by the carrying unit. That is, the following explanatory diagram shows the relative positional relationship between the nozzles and the paper.

<Regarding Band Printing>

Figure 15:
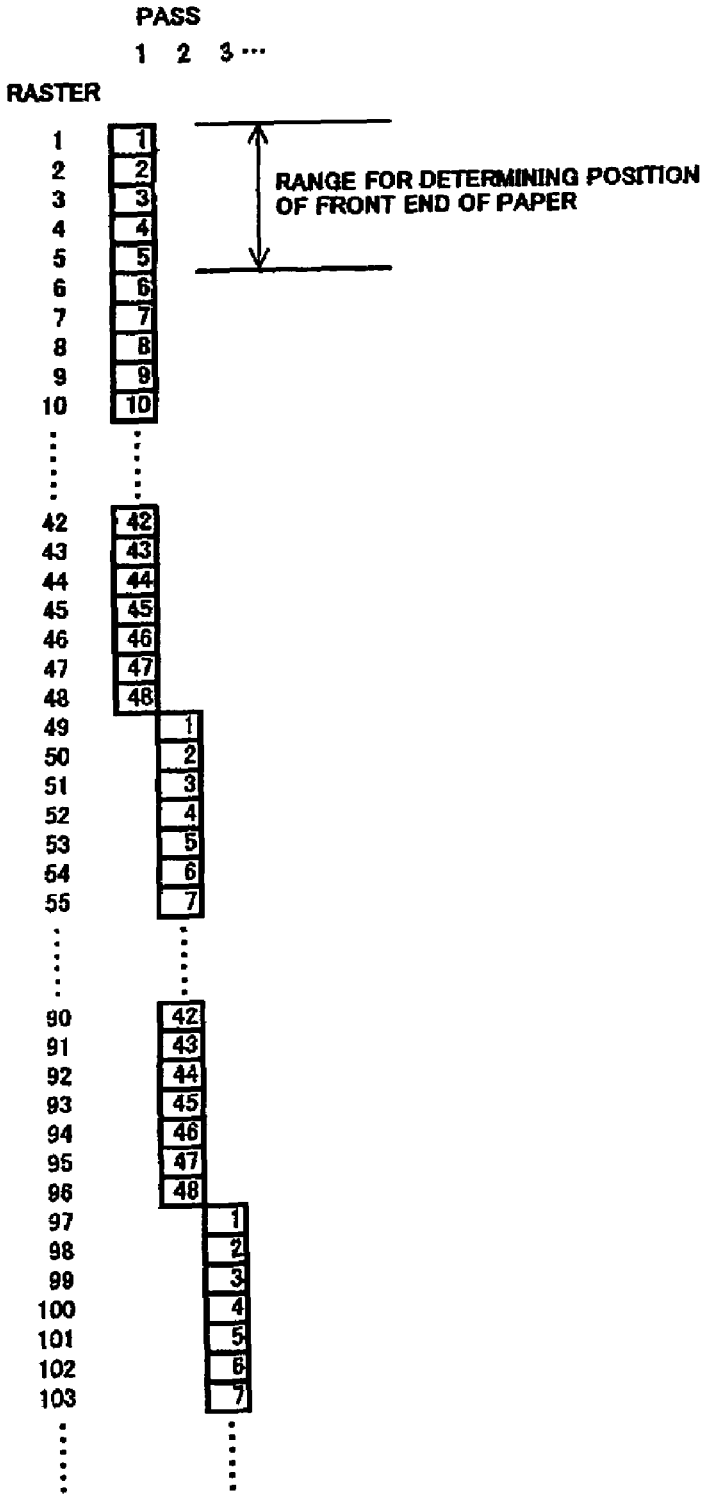
FIG. 15 is an explanatory diagram showing the carrying method in the case of a band printing method.

FIG. 15 is an explanatory diagram showing a printing method in the case of a band print mode, which is an example of the print mode.

Here, "band print mode" is used to mean a print mode in which the nozzle pitch is equal to the dot pitch (k=1) and a plurality of continuous raster lines are printed in a single pass. It should be noted that "pass" refers to a single scan in which the nozzles are moved in the scanning direction. Also, "raster lines" refer to the scan lines, and are the rows (dot rows) of pixels lined up in the scanning direction. "Pixels" are the square grids that are determined in a virtual manner on the medium to be printed in order to define the positions where ink droplets are made to land so as to record dots. Also, the plurality of raster lines that are printed in a single pass are referred to as a "band," and the width of the plurality of raster lines is referred to as the "band width." In this band print mode, the paper S is carried intermittently by a carry amount that is equal to the band width.

That is, in this diagram, raster lines are formed on the paper at a spacing of 1/180 inch, and 48 raster lines are formed in a single pass.

Also, this diagram shows how in the first pass the nozzle #1 ejects ink corresponding to a first raster line, and how in the second pass the nozzle #1 ejects ink corresponding to the 49th raster line. This diagram also shows how the paper is carried by 48/180 inch every time the dot lines are finished being formed in each pass.

In this embodiment, the paper carrying unit carries the paper so that the front end of the paper is positioned above the downstream side groove (between the downstream side groove and nozzles #1 to #5). As described above, by doing this, in the first pass ink can be ejected from not only the downstream side supra-groove nozzle group Nr (nozzles #1 to #5) but also can be ejected from the nozzles upstream of the downstream side supra-groove nozzle group Nr (nozzles #6 to #48). As a result, printing can be carried out quickly, even when the front end of the paper is printed.

It should be noted that in this embodiment, if the front end of the paper is initially positioned at the position of nozzle #3, for example, then the dot row corresponding to the third raster line is printed at the front end. In this case, the ink droplets that are ejected from nozzle #1 and nozzle #2 in the first pass land in the downstream side groove.

<Regarding Pseudo Band Printing>

Figure 16:
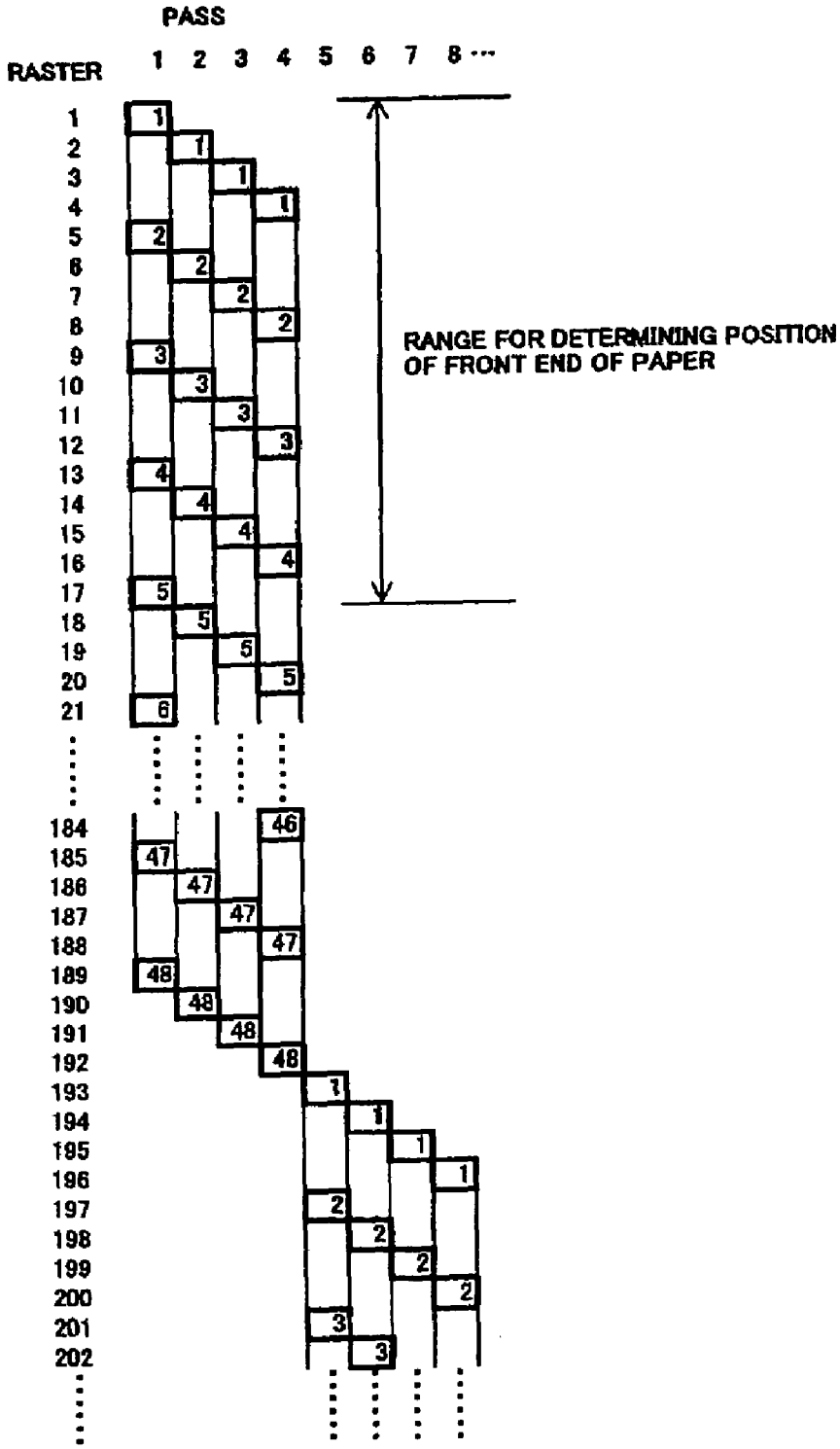
FIG. 16 is an explanatory diagram showing the printing method in the case of a pseudo band printing method.

FIG. 16 is an explanatory diagram showing a printing method in a case of a pseudo band print mode, which is another example of a print mode.

Here, "pseudo band print mode" means a print mode in which k is at least 2 and printing is carried out in pseudo bands. It should be noted that a pseudo band refers to a plurality of continuous raster lines printed in a plurality of passes. That is, with the pseudo band print mode, the amount that the paper is carried when printing a pseudo band is the dot pitch D, and the target carry amount after the pseudo band has been completed is the pseudo band width (more specifically, the quantity obtained by subtracting $(k-1)\cdot D$ from the pseudo band width).

In the diagram, the pseudo band made of the first to 192nd raster lines is completed in four passes (that is, the pseudo band width is $192\cdot D$). Also, three raster lines are formed in 1/180 inch, which is the nozzle spacing. That is, the diagram shows a pseudo band print mode in which raster lines are formed on the paper at a spacing of 1/720 inch.

Also, the diagram shows how nozzle #1 in the first pass ejects ink corresponding to the first raster line, in the second pass ejects ink corresponding to the second raster line, in the third pass ejects ink corresponding to the third raster line, in the fourth pass ejects ink corresponding to the fourth raster line, and in the fifth pass ejects ink corresponding to the 193rd raster line. The diagram also shows how the paper is carried by 1/720 inch each time the formation of dots is finished in the first to fourth passes. Furthermore, the diagram also shows how the paper is carried 189/720 inch after the fourth pass is over.

In this embodiment, the paper carrying unit carries the paper so that the front end of the paper is positioned above the downstream side groove (between the downstream side groove and nozzles #l to #5). As described above, by doing this, in the first pass ink can be ejected from not only the nozzle group Nr (nozzles #1 to #5) but also can be ejected from the nozzles upstream of the nozzle group Nr (nozzles #6 to #48). As a result, printing can be carried out quickly, even when the front end of the paper is printed.

It should be noted that in this embodiment, if the front end of the paper is initially positioned at the position of nozzle #3, for example, then the dot row corresponding to the ninth raster line is printed at the front end. In this case, the ink droplets that are ejected from nozzle #1 and nozzle #2 in the first pass land in the downstream side groove.

<Regarding Interlace Printing>

Figure 17:
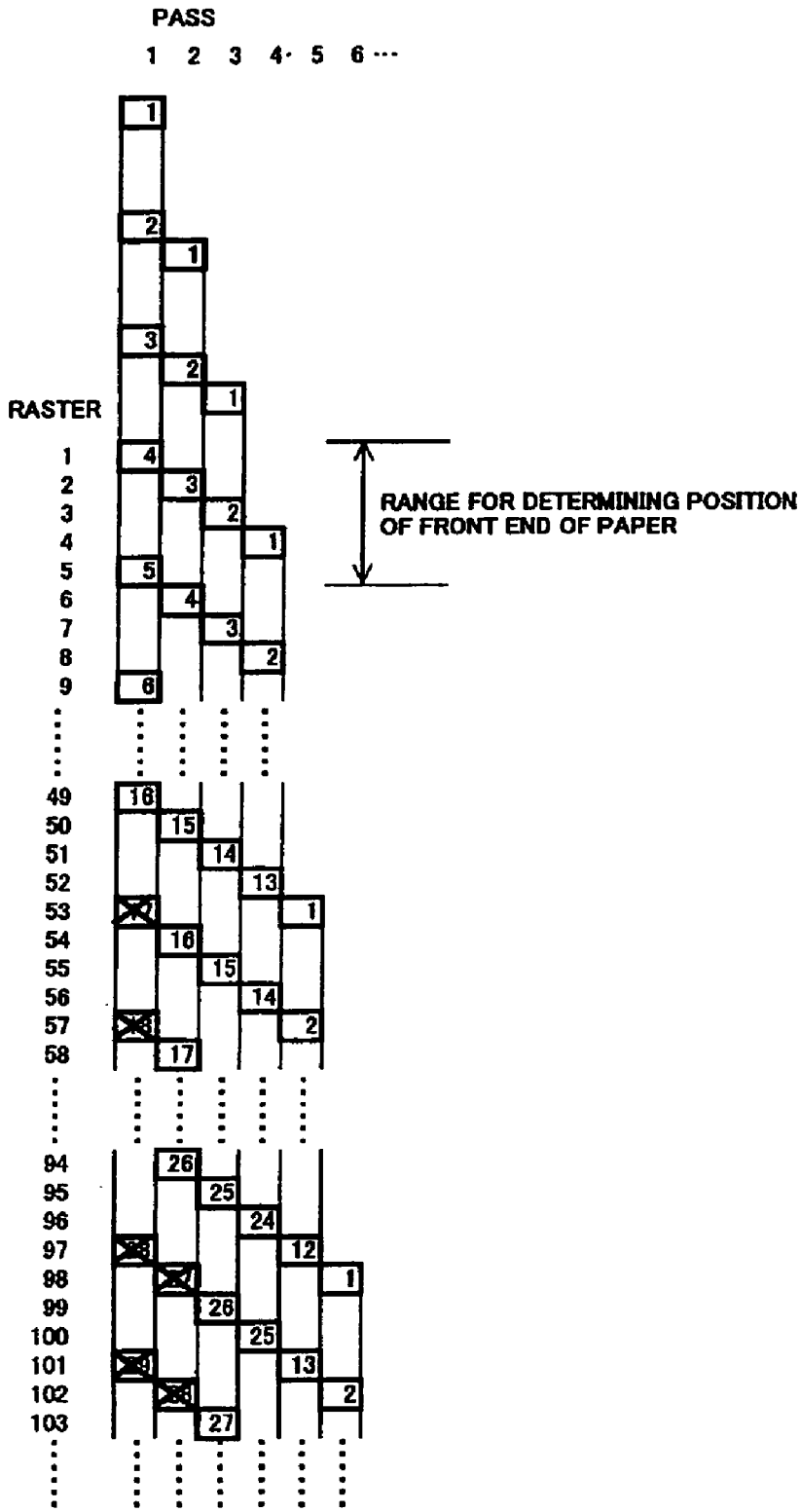
FIG. 17 is an explanatory diagram showing the printing method in the case of an interlace printing method.

FIG. 17 is an explanatory diagram showing the printing method in the case of an interlace print mode, which is another example of a print mode.

Here, the "interlace mode" refers to a print mode in which k is at least 2 and a raster line that is not recorded is sandwiched between the raster lines that are recorded in a single pass.

This diagram shows an interlace printing formation in which raster lines are formed on the paper at a spacing of 1/720 because four raster lines are formed in 1/180 inch, which is the nozzle spacing. With the interlace printing according to this embodiment, each time the paper S is carried by a constant carry amount F in the scanning direction, the nozzles record a raster line immediately above the raster line that was recorded in the previous pass.

Then, nozzle #4 in the first pass ejects ink corresponding to the first raster line. However, in the first pass, the nozzles from nozzle #17 and thereafter do not eject ink. Also, nozzle #3 in the second pass ejects ink corresponding to the second raster line. However, in the second pass, nozzles from nozzle #27 and thereafter do not eject ink. Then, in the third pass, nozzle #2 ejects ink corresponding to the third raster line. However, in the third pass, the nozzles from nozzle #39 and thereafter do not eject ink (not shown). Next, in the fourth pass, nozzle #1 ejects ink corresponding to the fourth raster line. Also, in the fifth pass nozzle #1 ejects ink corresponding to the 53rd raster line. It should be noted that from the fourth pass and thereafter ink is ejected from all of the nozzles. The diagram also shows how the paper is carried by 5/720 inch each time the formation of dots is finished in each of the first through fourth passes. Moreover, the diagram also shows how the paper is carried by 47/720 inch after the fifth pass and thereafter.

In this embodiment, the paper carrying unit carries the paper so that the front end of the paper is positioned between the downstream side groove and nozzles #4 to #5. As described above, by doing this, in the first pass ink can be ejected from not only the nozzles #4 and #5 but also can be ejected from nozzle #6 and thereafter. As a result, printing can be carried out quickly, even when printing the front end of the paper.

It should be noted that in this embodiment, if the front end of the paper is initially positioned upstream of nozzle #4 by the amount of two raster lines, for example, then the dot row that is formed by nozzle #2 in the third pass is printed on the front end. In this case, the ink droplets that are ejected from nozzle #4 in the first pass land in the downstream side groove, and the ink droplets that are ejected by nozzle #3 in the second pass land in the downstream side groove.

It should be noted that in this embodiment, for example, nozzles #1 to #3 do not eject ink in the first pass because there are no data for the raster line. Consequently, in this embodiment, when the paper carrying unit carries the paper in such a manner that the front end of the paper is located between the downstream side groove and nozzles #1 to #4, the front end of the paper is not printed. In this way, it is necessary for the region in which the front end of the paper is positioned to differ according to the print mode.

In this embodiment, in passes one to four a front end printing process for printing the front end of the paper was performed. The amount that the paper is carried at this time is 5/720 inch. On the other hand, an ordinary interlace printing process is performed in passes five and thereafter, and the amount that the paper is carried at that time is 47/720 inch. It should be noted that in the first pass, the reason that ink is not ejected from nozzle #17 and thereafter is that from the fifth pass and thereafter the paper is carried by the carry amount for the ordinary interlace printing process. This is also why there are nozzles that do not eject ink in the second and third passes.

===Configuration of the Computer System etc.===

Next, an embodiment of a computer system, a computer program, and a storage medium storing the computer program are described with reference to the drawings.

Figure 18:
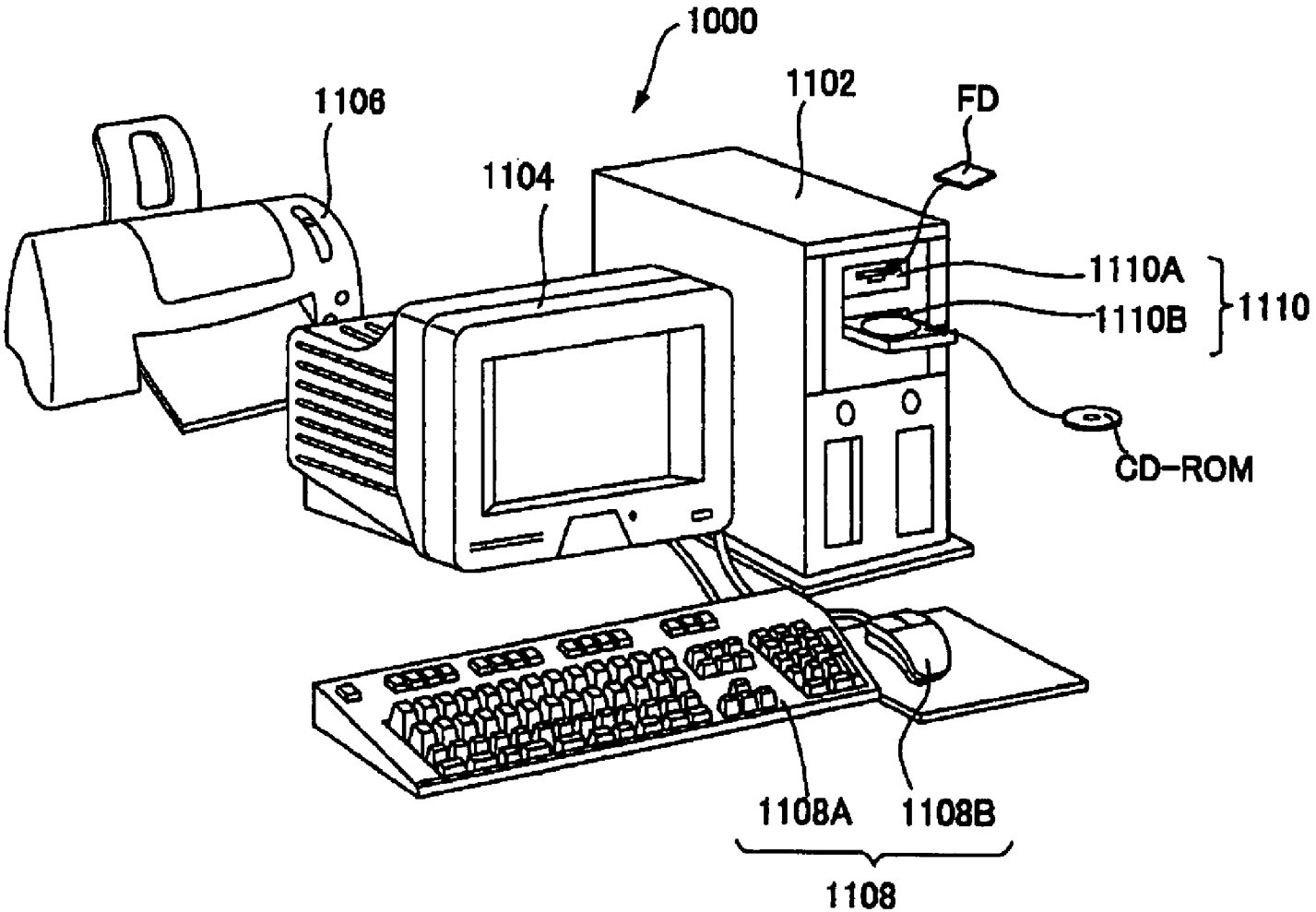
FIG. 18 is an explanatory diagram showing the external configuration of a computer system.

FIG. 18 is an explanatory drawing showing the external structure of the computer system. A computer system 1000 is provided with a main computer unit 1102, a display device 1104, a printer 1106, an input device 1108, and a reading device 1110. In this embodiment, the main computer unit 1102 is accommodated within a mini-tower type housing; however, this is not a limitation. A CRT (cathode ray tube), plasma display, or liquid crystal display device, for example, is generally used as the display device 1104, but this is not a limitation. The printer 1106 is the printer described above. In this embodiment, the input device 1108 is a keyboard 1108A and a mouse 1108B, but it is not limited to these. In this embodiment, a flexible disk drive device 1110A and a CD-ROM drive device 1110B are used as the reading device 1110, but the reading device 1110 is not limited to these, and it may also be an MO (magnet optical) disk drive device or a DVD (digital versatile disk), for example.

Figure 19:
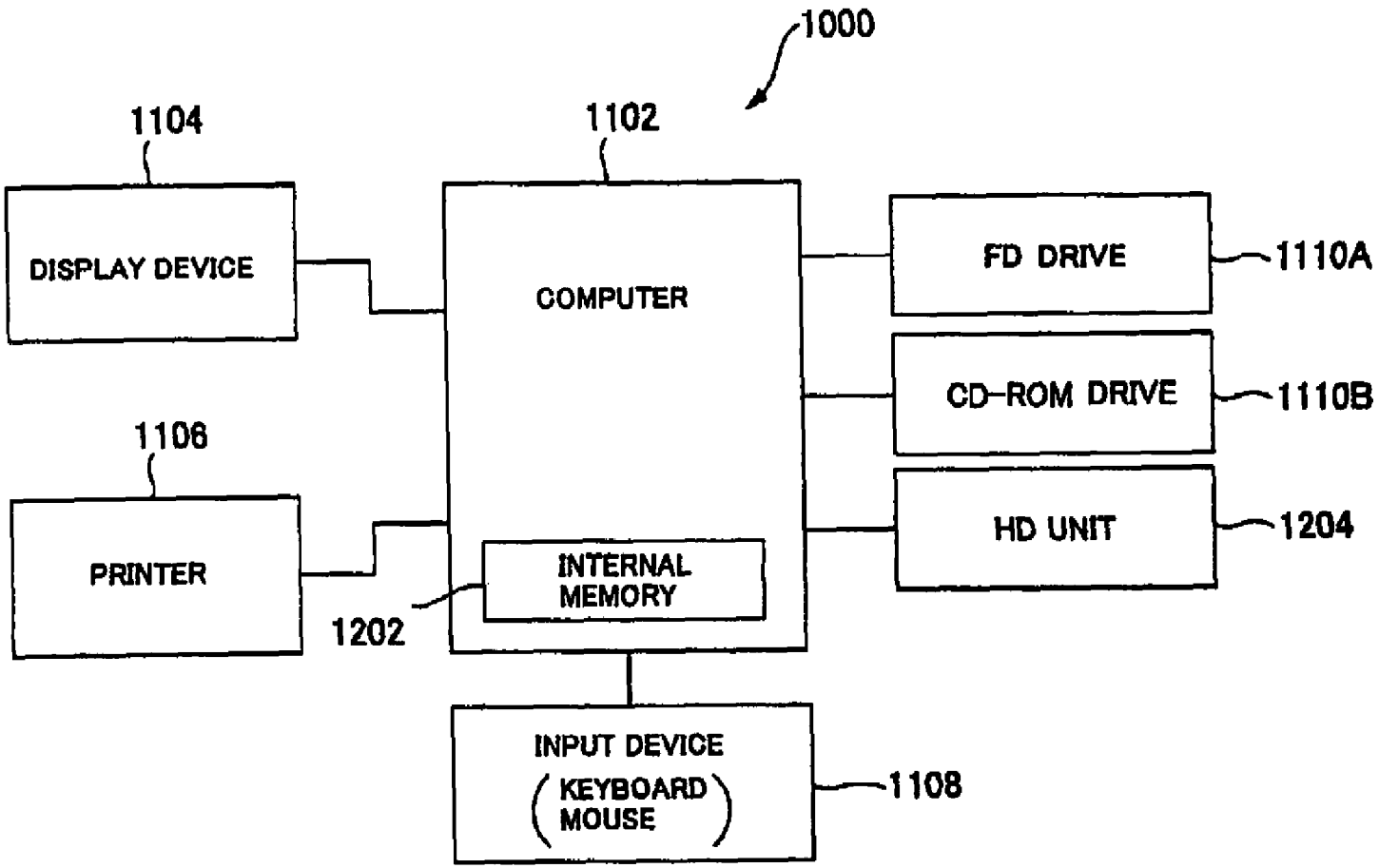
FIG. 19 is a block diagram showing the configuration of the computer system shown in FIG. 11.

FIG. 19 is a block diagram showing the configuration of the computer system shown in FIG. 18. An internal memory 1202 such as a RAM within the housing accommodating the main computer unit 1102 and, also, an external memory such as a hard disk drive unit 1204 are provided.

A computer program for controlling the operation of the above printer can be downloaded onto the computer system 1000, for example, connected to the printer 1106 via a communications line such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read by various types of reading devices 1110.

Figure 20:
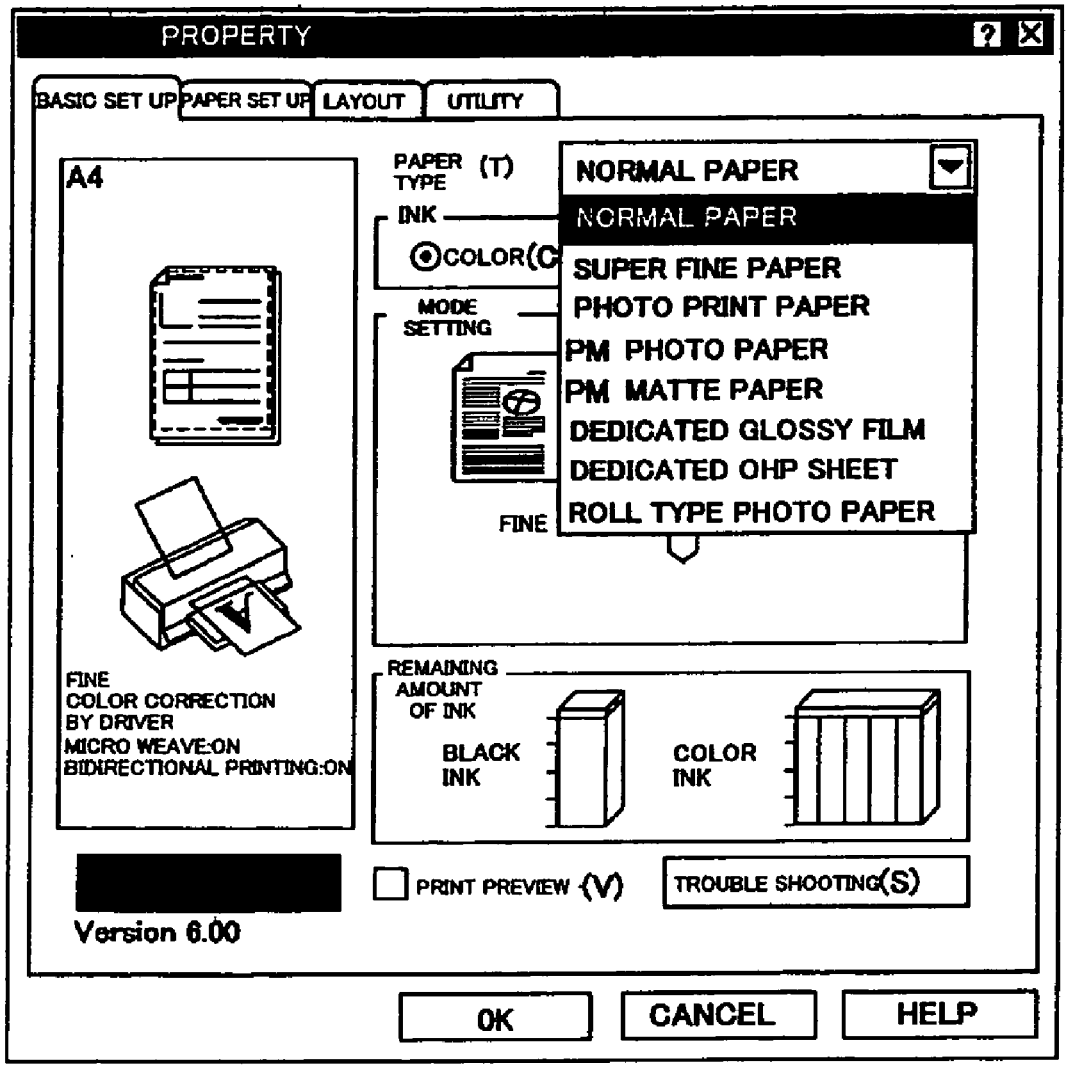
FIG. 20 is an explanatory diagram showing the user interface.

FIG. 20 is an explanatory diagram showing the user interface of a printer driver displayed on the screen of the display device 1104 connected to the computer system. The user can use the input device 1108 to change the various settings of the printer driver.

The user can select the print mode from this screen. For example, the user can select as the print mode, a quick print mode or a fine print mode. From this screen the user can also select the dot spacing (resolution) when printing. For example, from this screen the user can select 720 dpi or 360 dpi as the print resolution.

Figure 21:
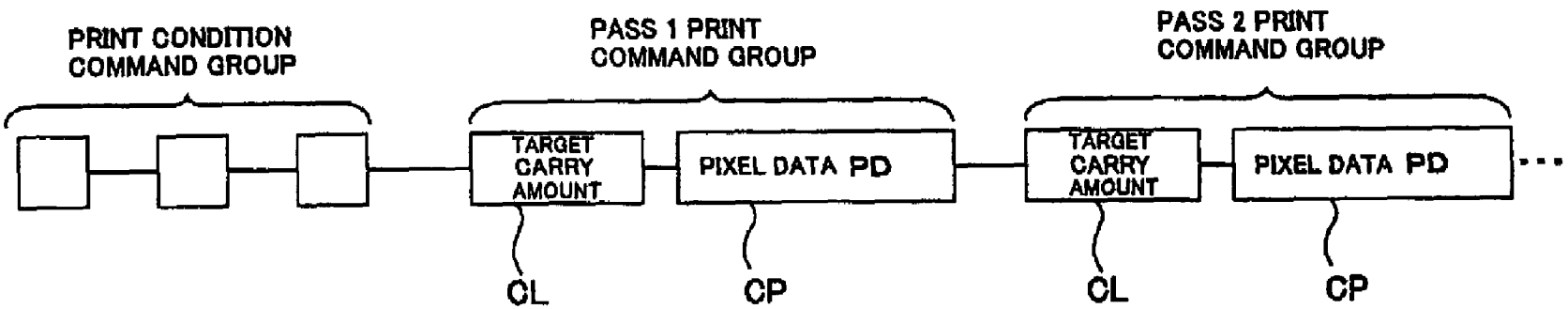
FIG. 21 is an explanatory diagram of the format of the print data.

FIG. 21 is an explanatory diagram of the format of the print data supplied from the main computer unit 1102 to the printer 1106. The print data are created from image information based on the settings of the printer driver. The print data have a print condition command group and pass command groups. The print condition command group includes a command for indicating the print resolution and a command for indicating the print direction (single direction/bidirectional), for example. The print command groups for each pass include a target carry amount command CL and a pixel data command CP. The pixel data command CP includes pixel data PD indicating the recording status for each pixel of the dots recorded in that pass. It should be noted that the various commands shown in the diagram each have a header section and a data section; however, here they are shown simplified. Also, these command groups are supplied intermittently to the printer side from the main computer unit side for each command. The print data are not limited to this format, however.

It should be noted that in the above description, an example was described in which the computer system is constituted by connecting the printer 1106 to the main computer unit 1102, the display device 1104, the input device 1108, and the reading device 1110; however, this is not a limitation. For example, the computer system can be made of the main computer unit 1102 and the printer 1106, or the computer system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. As an example, the printer 1106 may be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be incorporated in the memory 65, which is a storage medium of the control unit 60. Also, the control unit 60 may execute the computer program stored in the memory 65 so as to achieve the operations of the printer in the embodiment described above.

As an overall system, the computer system that is thus achieved is superior to conventional systems.

===Other Embodiments===

The foregoing embodiment described primarily a printer. However, it goes without saying that the foregoing description also includes the disclosure of printing apparatuses, printing methods, programs, computer-readable storage media, computer systems, display screens, screen display methods, methods for manufacturing printed material, recording apparatuses, and devices for ejecting liquids, for example.

Also, a printer, for example, serving as an embodiment was described above. However, the foregoing embodiment is for the purpose of elucidating the present invention and is not to be interpreted as limiting the present invention. The invention can of course be altered and improved without departing from the gist thereof and includes functional equivalents. In particular, the embodiments mentioned below are also included in the invention.

<Regarding the Recording Apparatus>

A printer (printing apparatus) was described as a recording apparatus in the foregoing embodiment. However, this is not a limitation. For example, technology like that of the present embodiment can also be adopted for various types of recording apparatuses that use inkjet technology, including color filter manufacturing devices, dyeing devices, fine processing devices, semiconductor manufacturing devices, surface processing devices, three-dimensional shape forming machines, liquid vaporizing devices, organic EL manufacturing devices (particularly macromolecular EL manufacturing devices), display manufacturing devices, film formation devices, and DNA chip manufacturing devices. Also, these methods and manufacturing methods are within the scope of application. Even when the present technology is adopted in these fields, the fact that liquid can be directly ejected (directly written) to a target object allows a reduction in material, process steps, and costs compared to conventional cases to be achieved.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject from the nozzles a liquid (including water) including metallic material, organic material (particularly macromolecular material), magnetic material, conductive material, wiring material, film-formation material, electronic ink, processed liquid, and genetic solutions. A reduction in material, process steps, and costs can be achieved if such liquids are directly ejected toward a target object.

<Regarding the Nozzles 1>

In the foregoing embodiment, ink was ejected using piezoelectric elements. However, the method for ejecting liquid is not limited to this. Other methods, such as a method for generating bubbles in the nozzles through heat, may also be employed.

<Regarding the Nozzles 2>

In the foregoing embodiment, the number of nozzles in the nozzle groups for the various colors was 48 nozzles. However, it goes without saying that there is no limit to the number of nozzles being 48 nozzles.

Moreover, in the foregoing embodiment, the downstream side supra-groove nozzle group Nr was constituted by nozzles #1 to #5. However, it goes without saying that the downstream side supra-groove nozzles Nr are not limited to these.

<Regarding the Paper Carrying Unit>

In the foregoing embodiment, the paper carrying unit, using a PF motor constituted by a DC motor as its drive source, carried the paper while controlling the amount of rotation of the carry roller with the rotary encoder. However, the paper carrying unit it not limited to this configuration. For example, it may also have other configurations, such as a configuration in which a pulse motor or the like is used as its drive source. In other words, it is only necessary that the paper carrying unit is configured to function as a paper carrying mechanism for carrying paper.

<Regarding the Paper Width Sensor>

In the foregoing embodiment, the front end of the paper was detected using a paper width sensor. However, detection of the front end of the paper is not limited to detection using the paper width sensor. For example, it is also possible to provide a separate sensor for detecting the front end of the paper. In other words, it is only necessary that the front end of the paper is detected and that the results of that detection can be used.

<Regarding the Paper Detection Sensor>

In the foregoing embodiment, the paper detection sensor was a mechanical sensor. However, the paper detection sensor can also be an optical sensor.

Also, in the foregoing embodiment, to accurately position the front end of the paper, positioning of the paper was carried out based on the results of detection by the paper width sensor. However, if the front end of the paper can be positioned above the downstream side groove, then the paper can be carried based on the results of detection by the paper detection sensor.

<Regarding the Grooves>

Figure 22:
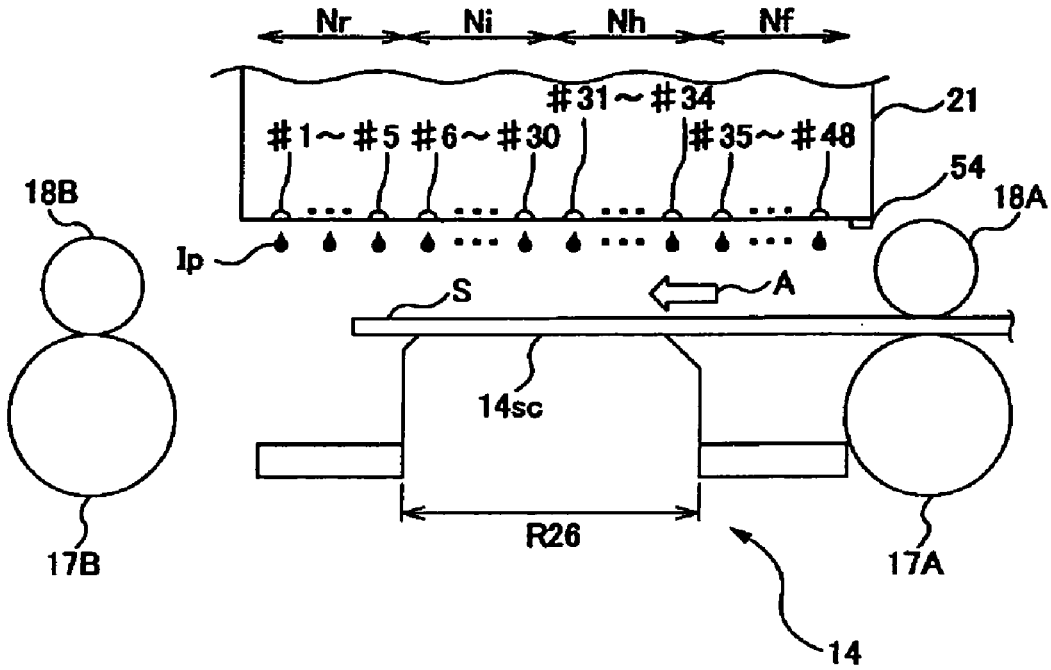
FIG. 22 is an explanatory diagram of the platen according to another embodiment.
Figure 23:
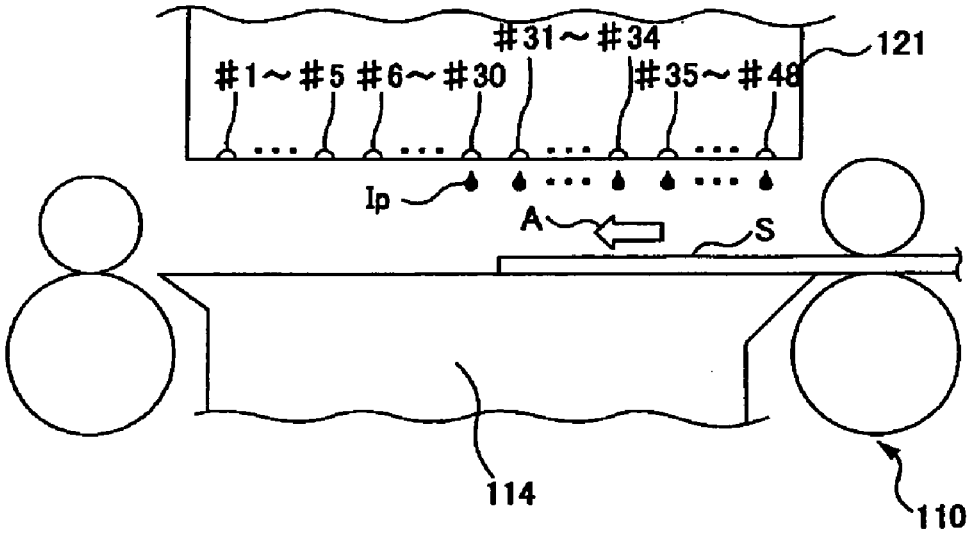
FIG. 23 is an explanatory diagram of the printing method of the background art.

In the foregoing embodiment, the platen was provided with grooves as its recessed sections. However, the recessed sections are not limited to this. For example, as shown in FIG. 22, it is also possible for the recessed sections to simply be recessed with respect to the protruding sections supporting the paper.

<Regarding the Linear Encoder>

In the foregoing embodiment, the position of the carriage in the scanning direction is detected by the linear encoder. However, detection of the position of the carriage is not limited to this. For example, the carriage motor may be a pulse motor, and the position of the carriage may be measured based on the number of pulses applied to the motor.

<Regarding the Print Mode>

The foregoing embodiment described a band print mode, a pseudo band print mode, and an interlace print mode. However, the print mode is of course not limited to these print modes.

As set forth above, the present embodiment allows recording to be carried out quickly and without making the periphery dirty when recording to the front end of a medium to be recorded without creating a margin section.

What is claimed is:

1. A recording method for recording by ejecting a liquid onto a medium, comprising:

carrying said medium in a carrying direction;

supporting said medium, which is carried, by a protruding section of a support member having a recessed section and said protruding section, said recessed section formed along a scan direction in which a plurality of nozzles move, ejecting said liquid from said plurality of nozzles that are provided in opposition to said recessed section and said protruding section;

wherein when recording to a front end, in said carrying direction, of said medium, said front end of said medium is detected by a detector provided in/on a carriage for moving said nozzles in said scan direction, said medium is carried based on the result of the detection of said detector, said medium is carried to position said front end between said recessed section and nozzles that are provided in opposition to said recessed section, and said liquid is ejected from said nozzles that are provided in opposition to said recessed section and nozzles that are provided in opposition to said protruding section.

2. A recording method according to claim 1, wherein:

a roller is used to carry said medium, and said front end of said medium is detected downstream of said roller in said carrying direction.

3. A recording method according to claim 1, wherein:

skew of said medium is corrected, and said front end of said medium is detected after said skew of said medium is corrected.

4. A recording method according to claim 1, wherein said front end of said medium is detected at a position upstream, in said carrying direction, of said nozzles that are provided in opposition to said recessed section.

5. A recording method according to claim 1, wherein said recessed section is a groove provided in said support member.

6. A recording method according to claim 1, wherein an absorptive body for absorbing said liquid is provided in said recessed section.

7. A recording method according to claim 1, wherein a carry amount by which said medium is carried when recording to said front end is less than a carry amount by which said medium is carried after recording to said front end is finished.

8. A recording method according to claim 1, wherein printing of said medium is carried out by ejecting ink from said nozzles.

9. A recording method for recording by ejecting a liquid onto a medium, comprising:

carrying said medium in a carrying direction;

supporting said medium, which is carried, by a protruding section of a support member having a recessed section and said protruding section, said recessed section formed along a scan direction in which a plurality of nozzles move, ejecting said liquid from said plurality of nozzles that are provided in opposition to said recessed section and said protruding section;

wherein:

when recording to a front end, in said carrying direction of said medium, said front end of said medium is detected by a detector provided in/on a carriage for moving said nozzles in said scan direction, said medium is carried based on the result of the detection of said detector, said medium is carried to position said front end between said recessed section and nozzles that are provided in opposition to said recessed section, and said liquid is ejected from said nozzles that are provided in opposition to said recessed section and nozzles that are provided in opposition to said protruding section;

a roller is used to carry said medium;

said front end of said medium is detected downstream of said roller in said carrying direction;

skew of said medium is corrected, and said front end of said medium is detected after said skew of said medium is corrected;

said front end of said medium is detected at a position upstream, in said carrying direction, of said nozzles that are provided in opposition to said recessed section;

said recessed section is a groove provided in said support member;

an absorptive body for absorbing said liquid is provided in said recessed section;

a carry amount by which said medium is carried when recording to said front end is less than a carry amount by which said medium is carried after recording to said front end is finished; and printing of said medium is carried out by ejecting ink from said nozzles.

10. A recording apparatus for carrying out recording to medium, comprising:

a carrying mechanism for carrying said medium in a carrying direction;

a supporting member that has a recessed section and a protruding section, said recessed section formed along a scan direction in which a plurality of nozzles move, and that supports said medium by said protruding section, a detector provided in/on a carriage for moving a plurality of nozzles that are provided in opposition to said recessed section and said protruding section;

wherein when recording to a front end, in said carrying direction, of said medium, said front end of said medium is detected by said detector, said medium is carried based on the result of the detection of said detector, said medium is carried to position said front end between said recessed section and nozzles that are provided in opposition to said recessed section, and a liquid is ejected from said nozzles that are provided in opposition to said recessed section and nozzles that are provided in opposition to said protruding section.

11. A computer-readable medium for controlling a recording apparatus, having codes for said recording apparatus comprising a carrying mechanism for carrying a medium to be recorded in a carrying direction, a supporting member that has a recessed section and a protruding section, said recessed section formed along a scan direction in which a plurality of nozzles move, and that supports said medium by said protruding section, and a detector provided in /on a carriage for moving a plurality of nozzles that are provided in opposition to said recessed section and said protruding section, said codes comprising:

a code that causes said detector to detect a front end, in said carrying direction, of said medium, when recording to said front end of said medium;

a code that causes said carrying mechanism to carry said medium based on the result of the detection of said detector, and to position said front end between said recessed section and nozzles that are provided in opposition to said recessed section, when recording to said front end of said medium; and a code that causes a liquid to be ejected from nozzles that provided in opposition to said recessed section and nozzles that are provided in opposition to said protruding section, when recording to said front end of said medium.

* * * * *